US010051959B1

(12) United States Patent
Glidewell

(10) Patent No.: US 10,051,959 B1
(45) Date of Patent: Aug. 21, 2018

(54) COMPACT AND ADJUSTABLE CLOSET HANGING CLOSET RACK AND ORGANIZER, AND METHOD FOR MAKING SAME

(71) Applicant: Kathleen A. Glidewell, The Colony, TX (US)

(72) Inventor: Kathleen A. Glidewell, The Colony, TX (US)

( * ) Notice: Subject to any disclaimer, the term of this patent is extended or adjusted under 35 U.S.C. 154(b) by 0 days.

(21) Appl. No.: 15/816,997

(22) Filed: Nov. 17, 2017

(51) Int. Cl.

| | |
|---|---|
| ***A47H 1/00*** | (2006.01) |
| ***A47B 61/02*** | (2006.01) |
| ***A47B 61/00*** | (2006.01) |
| *A47H 1/13* | (2006.01) |
| *A47K 10/04* | (2006.01) |
| *A47H 1/022* | (2006.01) |
| *A47G 25/06* | (2006.01) |

(52) U.S. Cl.
CPC ..... *A47B 61/02* (2013.01); *A47B 61/003* (2013.01); *A47G 25/0692* (2013.01); *A47H 1/022* (2013.01); *A47H 1/13* (2013.01); *A47K 10/04* (2013.01)

(58) Field of Classification Search
CPC . A47H 1/02; A47H 1/142; A47H 1/13; A47H 1/022; A47H 1/08; A47H 1/122; A47H 1/14; A47B 61/02; A47B 61/003; A47G 25/0692; A47K 10/04
USPC ..... 211/105.1–105.6, 123, 16, 85.3, 90.01, 211/182, 90.02, 88.04, 87.01; 248/235, 248/241, 250–265; 108/29, 30, 108; 160/330
See application file for complete search history.

(56) References Cited

U.S. PATENT DOCUMENTS

| | | | | |
|---|---|---|---|---|
| 113,398 A * | 4/1871 | Chandler | ..... | A47K 10/04 211/88.04 |
| 356,380 A * | 1/1887 | Scribner | ..... | A47K 10/04 211/16 |
| 368,740 A * | 8/1887 | Trimble | ..... | A47H 1/13 248/225.11 |
| 704,351 A * | 7/1902 | Lyons | ..... | A47H 1/13 248/257 |

(Continued)

*Primary Examiner* — Abigail E Troy
*Assistant Examiner* — Devin K Barnett
(74) *Attorney, Agent, or Firm* — Hemingway & Hansen, LLP; D. Scott Hemingway

(57) ABSTRACT

The present invention to a compact and adjustable hanging closet rack and organizer, and the method of making same. A closet hanger spacing device includes one or more pairs of horizontal rods where one or more of the rods in the pairs of horizontal rods are affixed to a stationary wall structure, and the spacing between the one or more rods in the rod pairs to the stationary wall being adjustable. The pairs of horizontally-oriented rods are rotatable about an axis of rotation, which can be the rod in the pair of rods that is affixed to the stationary wall, and the space between the rod pairs can be adjusted to lengthen or shorten the spacing between the pair of rods. Each of the rods in the pairs of horizontal rods is capped at the rod ends and each rod end is extendable lengthwise to widen the reach of the pairs of horizontally oriented rods. Each of rods can be partially covered by an abrasive friction surface, and the rod pairs can support a flat surfaced shelf with a curved upper portion for engaging the upper rod of the rod pair and a lower ledge oriented upward from the lower rod of the rod pair.

22 Claims, 6 Drawing Sheets

(56) References Cited

U.S. PATENT DOCUMENTS 723,583 A * 3/1903 Chabot ..... A47H 1/13 248/260
756,361 A * 4/1904 Hatter ..... A47H 1/13 248/257
762,594 A * 6/1904 Michaels ..... F16B 15/04 248/216.1
787,751 A * 4/1905 Grant ..... A47H 1/13 248/252
807,108 A * 12/1905 Cooper ..... A47H 1/13 248/252
824,067 A * 6/1906 Dennis ..... A47H 1/13 248/256
830,319 A * 9/1906 Harper ..... A47H 1/13 248/252
833,557 A * 10/1906 Snyder ..... A47H 1/022 22/105.6
845,935 A * 3/1907 Dolson ..... A47H 1/13 248/254
895,375 A * 8/1908 Kreidler ..... A01K 31/12 119/533
897,076 A * 8/1908 Eustis ..... A47B 96/027 114/79 R
905,949 A * 12/1908 Stuck ..... A47H 1/13 248/252
913,019 A * 2/1909 Logsdon ..... A47H 1/13 248/252
913,228 A * 2/1909 McCarthy ..... B61D 37/003 211/90.01
914,276 A * 3/1909 Hopkins ..... A47H 1/13 248/252
928,329 A * 7/1909 Renzenbrink ..... A47H 1/13 248/259
932,308 A * 8/1909 McCoy ..... A47H 1/13 248/258
932,975 A * 8/1909 Dzimian ..... A47H 1/13 248/252
933,249 A * 9/1909 Hafer ..... A47H 1/13 248/252
939,808 A * 11/1909 Cook ..... A47H 1/13 248/252
951,440 A * 3/1910 Hoxworth ..... A47H 1/13 248/254
953,130 A 3/1910 Fellows
983,692 A * 2/1911 Deucker ..... A47H 1/142 248/263
1,021,838 A * 4/1912 Kinney ..... A47B 61/00 105/325
1,026,652 A * 5/1912 Bradley ..... A47H 1/13 248/257
1,035,967 A * 8/1912 Keil ..... A47B 96/027 211/86.01
1,036,785 A * 8/1912 Bergstrom ..... A47H 1/13 248/260
1,046,646 A * 12/1912 Richard ..... A47H 1/13 248/252
1,098,821 A * 6/1914 Michalski ..... A47H 1/13 248/257
1,120,935 A * 12/1914 Hammers ..... A47H 1/13 248/253
1,141,757 A * 6/1915 Bitting ..... A47H 1/13 248/257
1,150,693 A * 8/1915 Miller ..... A47H 1/122 248/257
1,153,069 A * 9/1915 Hallaire ..... A47H 1/13 248/259
1,153,929 A * 9/1915 Kearns ..... A45D 44/02 108/50.15
1,168,814 A * 1/1916 Lynk ..... A47H 1/13 248/252
1,202,190 A * 10/1916 Kern ..... A47K 10/38 211/16
1,210,947 A * 1/1917 Kirsch ..... A47H 1/142 248/263
1,216,271 A * 2/1917 Behl ..... E06B 9/52 160/128
1,231,496 A * 6/1917 Clugston ..... A47H 1/13 248/252
1,259,532 A * 3/1918 Leach ..... A47B 61/00 108/134
1,278,260 A * 9/1918 Tragethon ..... A47H 1/13 248/254
1,291,249 A * 1/1919 Taylor ..... A47H 1/13 248/254
1,299,223 A * 4/1919 Primm ..... A47H 1/13 248/254
1,299,568 A * 4/1919 Ferko ..... A47H 1/13 248/260
1,344,298 A * 6/1920 Fields ..... A47H 1/13 248/260
1,345,170 A * 6/1920 Gross ..... A47H 1/022 211/105.2
1,349,041 A * 8/1920 Boye ..... A47H 1/022 211/105.2
1,373,333 A * 3/1921 Kennedy ..... A47H 1/13 248/256
1,386,775 A 8/1921 Fulford
1,391,599 A * 9/1921 Wood ..... A47H 1/13 211/105.1
1,392,405 A * 10/1921 Dougherty ..... A47H 1/13 248/258
1,454,557 A * 5/1923 Nietzel ..... A47H 1/13 248/256
1,480,841 A * 1/1924 Simmons ..... A47H 1/16 248/254
1,485,117 A * 2/1924 Kuzniewski ..... A47H 1/13 248/265
1,485,145 A * 2/1924 Morrison ..... A47H 1/13 248/256
1,498,456 A * 6/1924 Kroder ..... A47H 1/122 248/263
1,518,245 A * 12/1924 Boye ..... A47H 1/124 211/105.2
1,533,709 A * 4/1925 Saksa ..... A47H 1/13 248/260
1,537,242 A * 5/1925 Lukins ..... F24D 19/00 126/332
1,537,497 A * 5/1925 Rains ..... A47H 1/13 160/112
1,542,181 A 6/1925 Sherman
1,591,838 A * 7/1926 Kaibas ..... A47H 1/13 248/253
1,593,114 A * 7/1926 Wyatt ..... A47H 1/142 248/255
1,594,268 A * 7/1926 Machowicz ..... A47H 1/13 248/256
1,595,940 A 8/1926 Inman
1,601,372 A * 9/1926 Ranson ..... A47H 1/13 16/94 D
1,643,061 A * 9/1927 Denney ..... A47H 1/13 248/256
1,712,834 A * 5/1929 McClure ..... A47H 1/13 248/256
1,733,487 A 10/1929 Hackley
1,768,187 A * 6/1930 Bushey ..... A47H 1/13 248/253
RE17,896 E * 12/1930 Whitney ..... A47H 1/13 248/253
1,863,204 A 6/1932 Miller
1,874,056 A 8/1932 Matallana
2,090,108 A 8/1937 Cicero
2,091,599 A * 8/1937 Larson ..... B60R 5/003 108/23
2,147,625 A * 2/1939 Brothers ..... A47G 25/746 16/87.4 R
2,271,784 A * 2/1942 Tritt ..... A47B 96/061 211/123

(56) References Cited

U.S. PATENT DOCUMENTS 2,386,854 A * 10/1945 Hilton ..... A47H 1/142 248/254
2,396,751 A * 3/1946 Resnick ..... A47G 25/746 211/124
2,461,316 A * 2/1949 Di Lorenzo ..... A47H 1/13 248/256
2,484,021 A * 10/1949 Eaves ..... B60R 5/003 248/251
2,491,127 A * 12/1949 Morton ..... E06B 9/50 248/253
2,525,259 A * 10/1950 Fenzl ..... A47G 25/746 211/124
2,584,644 A * 2/1952 Verdi ..... A47L 13/512 211/105.1
2,606,667 A * 8/1952 Hornick ..... A47K 10/10 188/69
2,624,468 A * 1/1953 McCauley ..... A47G 25/06 108/29
2,633,998 A * 4/1953 Derman ..... A47G 25/08 108/135
2,645,445 A * 7/1953 Hein ..... A47H 1/13 248/253
2,647,641 A * 8/1953 Tritt ..... A47K 10/10 211/123
2,825,469 A * 3/1958 Watkins ..... A47K 10/04 211/105.3
2,893,676 A * 7/1959 Connors ..... A47K 1/08 248/222.14
2,964,277 A * 12/1960 Sonntag ..... A47H 1/142 248/205.1
3,060,490 A * 10/1962 Saito ..... A47H 1/124 16/95 D
3,096,731 A * 7/1963 Lehman ..... A47K 10/04 108/29
3,104,086 A * 9/1963 Salzmann ..... A47H 1/122 160/345
3,220,363 A * 11/1965 Gingher ..... A47B 96/027 108/108
3,313,424 A * 4/1967 Gingher ..... A47G 25/0692 16/87.2
3,456,807 A * 7/1969 Amato ..... A47K 10/04 211/105.1
3,459,277 A * 8/1969 Frederick ..... E06C 7/48 182/214
3,468,426 A * 9/1969 Loewy ..... A47B 61/04 211/35
3,595,510 A * 7/1971 Hutchinson ..... E04G 5/06 182/113
3,669,395 A * 6/1972 Gehrke ..... A47F 5/08 108/29
3,702,591 A * 11/1972 Banse ..... A47B 96/027 108/31
3,853,225 A * 12/1974 Gegauff ..... A47G 25/746 211/124
3,865,336 A * 2/1975 Robertson ..... A47B 61/00 108/29
4,118,087 A * 10/1978 Dorf ..... A47B 45/00 211/105.6
4,140,294 A * 2/1979 Zwarts ..... A47H 1/122 248/265
4,316,547 A * 2/1982 Varon ..... A47G 25/0692 211/105.1
4,407,476 A * 10/1983 Bohannan ..... A47B 96/021 108/152
4,694,532 A * 9/1987 Black ..... A47H 1/142 16/94 D
4,896,778 A 1/1990 Ferdinand et al.
4,915,343 A * 4/1990 Terlecke ..... A47H 1/14 248/222.41
D324,139 S 2/1992 Frazier
5,172,816 A * 12/1992 Kline ..... A47B 87/0207 211/194
5,205,524 A * 4/1993 Cohen ..... A47B 57/06 211/103
5,253,837 A * 10/1993 Loux ..... A47B 96/00 108/152
5,415,299 A * 5/1995 Usner ..... A47F 7/19 211/105.1
5,415,370 A * 5/1995 Valiulis ..... A47F 5/0006 211/57.1
5,433,152 A * 7/1995 Henry ..... A47B 96/028 108/42
5,584,404 A * 12/1996 Tsai ..... A47B 46/00 108/29
5,810,302 A * 9/1998 McCance ..... A47H 1/022 248/200.1
5,979,848 A * 11/1999 Kuthy ..... A47H 1/10 160/902
6,145,677 A * 11/2000 Corniel ..... A47G 25/0692 211/105.1
6,216,889 B1 * 4/2001 Chang ..... A47H 1/122 211/105.1
6,257,425 B1 * 7/2001 Liu ..... A47K 10/04 211/105.1
6,357,184 B1 * 3/2002 Alley ..... E04D 13/10 211/182
6,367,755 B1 * 4/2002 Arena ..... A47H 5/08 248/251
6,672,552 B1 * 1/2004 Jao ..... A46B 15/0087 248/251
6,883,671 B2 * 4/2005 Rushing ..... A47F 5/0018 206/736
7,237,687 B1 7/2007 Abdi et al.
7,249,679 B2 7/2007 Klein
7,249,685 B2 * 7/2007 Newman ..... A47B 43/00 211/87.01
D554,982 S * 11/2007 Wenck ..... D8/376
7,325,696 B2 * 2/2008 Matthew ..... B60R 7/10 211/105.3
7,431,067 B2 * 10/2008 Nien ..... A47H 1/00 16/87 R
D598,218 S 8/2009 Siegel
8,056,873 B1 * 11/2011 Hanley ..... A47H 1/022 248/261
8,210,365 B2 * 7/2012 Van Wyk ..... A47B 81/00 211/85.3
8,783,474 B2 * 7/2014 Kuhlman ..... B60N 3/02 211/113
8,905,248 B1 * 12/2014 Wolski ..... A47B 43/00 108/108
9,226,607 B1 * 1/2016 Lowman ..... A47H 1/022
9,486,090 B2 * 11/2016 Juric ..... A47F 5/005
9,615,659 B2 * 4/2017 King ..... A47B 61/003
9,743,762 B1 * 8/2017 Beuses ..... A47B 61/003
2002/0166829 A1 * 11/2002 Koellner ..... D06F 57/12 211/104
2003/0213762 A1 * 11/2003 Chang ..... A47B 96/068 211/90.01
2004/0020885 A1 * 2/2004 Newman ..... A47B 43/00 211/90.01
2004/0124165 A1 * 7/2004 Miller ..... A47B 45/00 211/153
2005/0218283 A1 * 10/2005 Goldstein ..... A47H 1/022 248/251
2006/0021722 A1 * 2/2006 Nien ..... A47H 1/102 160/330
2006/0260769 A1 * 11/2006 Nien ..... A47H 1/00 160/330
2007/0080125 A1 * 4/2007 Fratantoni ..... A47B 81/002 211/85.3
2007/0175842 A1 * 8/2007 Shieh ..... A47K 10/10 211/88.04
2008/0053931 A1 * 3/2008 Newbould ..... A47B 96/067 211/88.01
2008/0164393 A1 * 7/2008 Hung ..... A47H 1/02 248/251
2009/0101609 A1 * 4/2009 Batshon ..... A47H 1/022 211/105.3

(56) References Cited

U.S. PATENT DOCUMENTS

| | | | | |
|---|---|---|---|---|
| 2009/0139943 | A1* | 6/2009 | Fernandez | A47B 45/00 211/94.01 |
| 2009/0308995 | A1* | 12/2009 | Kuo | A47K 10/10 248/231.91 |
| 2010/0059462 | A1* | 3/2010 | Jones | A47B 61/003 211/85.3 |
| 2010/0176262 | A1* | 7/2010 | Vican | B62D 25/147 248/250 |
| 2011/0204014 | A1* | 8/2011 | Miller | A47B 5/00 211/90.01 |
| 2013/0341474 | A1* | 12/2013 | Baines | A47H 1/142 248/208 |
| 2016/0242586 | A1* | 8/2016 | Mateer | A47H 1/102 |
| 2018/0055221 | A1* | 3/2018 | Beuses | A47G 25/0692 |

* cited by examiner

COMPACT AND ADJUSTABLE CLOSET HANGING CLOSET RACK AND ORGANIZER, AND METHOD FOR MAKING SAME

TECHNICAL FIELD

The present invention to a compact and adjustable hanging closet rack and organizer, and the method of making same.

RELATED APPLICATION DATA

Not Applicable.

BACKGROUND OF THE INVENTION

Instruments and methods have been used in the state of the art to store personal and household items. These known instrumentalities, such as hooks, cases, closets, wardrobes and cabinets, have proven to be overly expensive and remarkably inflexible in solving the persistent and long-felt, unresolved problem of providing owners of personal and household items with an economical, flexible and adjustable storage solution.

Places in a home that are capable of storing clothes and other possessions are almost always used to their maximum capacity. For instance, closets often become cluttered, overcrowded, and messy, which often makes closets a very difficult place to keep cloths neat and organized. Regardless of the amount of storage space in a home, the allocated storage space almost always becomes fully (and quickly) occupied with items up to its capacity. Accordingly, there is almost a universal need for additional storage space.

In the instances where storage space becomes fully occupied, the owners of personal and household items have purchased large, obtrusive furnishings or fixtures to increase their storage space capacity in the household. In addition to being expensive, cumbersome and quickly occupied, many of these acquired storage instrumentalities do not provide any flexibility to the owner of the personal or household item, such as providing the owner with the ability to re-arrange or re-organize how items are being stored. In this way, most of the storage instrumentalities fail to provide adjustable storage space that can flexibly accommodate the space constraints in a household.

Another possible solution to the long-felt, unresolved need for additional economically viable, flexible and adjustable storage space is the construction or expansion of existing closet space. Adding extra closet space to an existing house structure, however, can be cost prohibitive—often requiring significant amounts of funding and incurring substantial construction efforts, as well as decreasing floor space in the home. The background of this invention will address, generally, closets, wardrobes and cabinets as several different types of storage units.

Closets

In Elizabethan and Middle English, a "closet" referred to a room where a person could sit and read in private. As time progressed, the term "closet" started to have a broader meaning relating to a small room or piece of furniture used to store clothing or other personal items. A closet in North American usage is an enclosed space, a cabinet, or a cupboard in a house or building used for general storage or handling or storing clothes. In British or Pakistan usage, a closet can also be a built-in cupboard or walk-in-wardrobe.

A closet usually refers to a small room used for storing things, especially one that is tall enough to walk into. Modern closets are usually built into the walls of the house during construction so that they do not use space from the accompanying room. A closet may also refer to a large, free-standing piece of furniture designed for clothing storage. Closets can also occupy spaces under stairs to fully utilize such awkward and otherwise unused spaces around the house.

There are many different types of closets. For instance, a broom closet is a closet with top to bottom space used for storing brooms, mops, vacuum cleaners, cleaning supplies, or buckets. A coat closet is a closet usually located near the front door of a home, and it usually stores coats, jackets, hoodies, sweatshirts, gloves, hats, scarfs, and boots/shoes. A coat closet sometimes has shelving, but it may also have a clothes rod and some bottom space used to store clothes in boxes or drawers. Some coat closets may also possess a top shelf for clothes storage above the clothes rod.

A line closet is a tall, narrow closet in the bathroom, which has shelves for storing towels, sheets, washcloths, and toiletries. A utility closet is most commonly used to store appliances and cleaning supplies, and a walk-in closet is a storage room with enough space for someone to stand in it while accessing the items stored therein. A wall closet is a closet in a bedroom that is built into the bedroom wall, and it may be closed by curtains or folding doors. Clothes are often hung or stored in such wall closets. Wall closet spaces, however, are not uniform spaces from house to house, and the storage space in such wall closets is often not utilized to maximum efficiency for the storage of personal and household items.

Conventional closet storage arrangements, even in the most expensive new housing units, usually serve the design-builder's desires rather than the occupant-owner's interests in effectively and efficiently storing items. Wooden cleats are often fastened to walls of such built-in closets (e.g. side walls, a back wall), and a wooden clothes pole is often situated approximately sixty-five inches above the closet floor to maintain hanging clothes and coats. The wooden clothes pole is often suspended across the width of a built-in closet, and it is usually positioned at a sufficient height to accommodate hanging the owner's longer garments.

In most built-in closets, a shelf is placed on top of cleats located on the inner sides of the closet near the wooden clothes pole. The shelf has a tendency, depending on the width of the closet, to sag over time as it sustains a carrying load thereupon. In a thirty-inch span for such a shelf, a bracket can be attached to the rear wall of the shelf to supplement the support of both the clothes pole and the shelf. This particular arrangement results in a significant amount of wasted space without significant flexibility in its use for a built-in closet, especially when space constraints and flexibility of storage arrangements in a household need to be maximized.

Most people find storage space in a conventional closet to be inadequate for their storage requirements because people fully occupy the available space, which leads to an ever present need for more garment hanging space and more shoe storage space. In most closets, multiple pairs of shoes are stored in a pile or some other type of unorganized manner. People have also found it useful to have more garment hanging space than a conventional closet can provide. For example, it is sometimes difficult for users to slide garment hangers on a wooden clothes pole because the garment hangers bind on the pole when loaded with clothes or coats.

Some known closet organizers make use of existing closet rods or shelving, but these known systems re-distribute the closet space rather than adding additional usable storage space. Further, such known closet organizers are usually a "one size fits all" solution for use in a typical-sized closet with a so-called standard depth, which means the known closet organizers usually cannot be flexibly adjusted to the accommodate different areas for storage.

Thus, a convenient item and shoe storage structure for shoes and garments in a closet is still needed, as well as a closet organizer that supplements storage space in a closet by adding more shoe storage and hanging space and re-organizes existing space. There is also need for a space saving device that adds supplemental storage space in a closet, organizes and re-organizes shoes and garment storage to maximize the efficient use of space in a closet, and is adjustable to flexibly accommodate different sized closet spaces.

Wardrobes

The term wardrobe appeared in the English language in the early 14th century, and it originated from Old French words warderobe, wardereube and garderobe, in which "warder" meant "to keep, to guard" and "robe" meant "garment." In old England, a wardrobe had an initial function as the location where the king's robe was stored.

Over time, the word wardrobe gained significance as referring to an independent storage building or space used to securely store all the precious items of the ruler, such as gold, valuable items, and robes. As kings, nobles, and royalty began to accumulate luxury items in their homes and castles, more space in the form of separate rooms were built to accommodate their clothes and valuables. The name of a wardrobe was given to such rooms in a noble's home where the wall-space was filled with closets and lockers for secure storage of their valuable possessions.

From these built-in cupboards and lockers, the modern piece of a furniture called a wardrobe evolved with its hanging spaces, sliding shelves, and drawers. A wardrobe usually refers to a standing piece of furniture that stores clothes, and the earliest wardrobes were crafted as a chest. Wardrobes can refer to a simple space where clothes are hung from metal bars or tucked inside utility racks running from up to down, sometimes with shelves for storing items.

In the latter half of the 16th century, wardrobe furniture was carved in a French Oakley style tallboy having under-cabinets instead of a chest with drawers. During that time period, wardrobes were also formed in a Chinese Ming Dynasty style using rosewood. In the United States, a wardrobe in its moveable form was fabricated using a "hanging cupboard" form, which is a form that dates back to the early 17th century. At that time, such wardrobe furniture was an early export product from America back to England, which were sometimes referred to as an Oakley because of the American-originated oak wood used in their construction.

For the next hundred year time period, such "oak" wardrobe furniture was produced in many different styles and numbers. As time progressed, wardrobes were produced from the plentiful American walnut because of the gradual decrease in the use of oak for cabinet-making purposes. Walnut succeeded oak as the favorite material for furniture, and during the 18th century, the tallboy wardrobe made of walnut became popular for storing clothes in America and Europe.

Hanging wardrobes appear to have been made frequently with drawers and sliding trays, although clothes presses were also present. In the nineteenth century, the wardrobe began to develop into its modern form with a hanging cupboard at each side and a central section with a press in the upper part and drawers below. Another step in the evolution of the wardrobe was taken when the central doors, which had previously enclosed an upper portion of the wardrobe, were extended to the floor. This extension of the central doors allowed the doors to cover the central drawers and sliding shelves, and these central doors were often fitted with mirrors.

In the United Kingdom, a wardrobe can be configured into a custom-fitted piece of furniture that is built around the size and shape of the room. A common feature of most wardrobes fitted in this manner is to size the furniture based on the eight small men method. In that measurement method, a good size for a double wardrobe was considered to be a furnishing capable of holding eight small men within its inner capacity.

The modern wardrobe differs in one respect from the historical furnishing by its triple partitioning. The triple partitioning has two linear compartments on either side with shelves and hanging pegs and drawers in a middle space. Modern wardrobes have the middle partitioned space in additions to a clothes' press in the higher central space on level with a person's chest.

Many modern wardrobes are commonly fabricated using mahogany wood. As previously scarce woods began to be obtainable in considerable quantities (e.g. satinwood), many wardrobes began to be inlaid with such wood features. Chippendale wardrobes possess unique carving features, while Sheraton and Hepplewhite wardrobes include artistic contrasted and highly polished woods.

Different forms of wardrobes and closets originated from different regions of the world. A Kas, kast or kasten (pronounced kaz) is a massive wardrobe furnishing of Dutch origin, which are similar to armoires that were popular in the Netherlands and America in the 17th and 18th century. Kastens were status symbols and family heirlooms in the Low Countries, with such luxury furnishings being imported to the American colonies in the 1700s. These furnishings were often made of quality wood such as cherry, rosewood and ebony woods with carved or painted panels. Such furniture was fitted with shelves and drawers to store linen, clothing and other valuables, and the contents were often securely locked in the furnishing a key.

Cabinets

A cabinet is usually formed as a box-shaped furnishing with doors or drawers for storing items. Cabinets usually have one or more doors on the front of the furnishing, which are mounted with door hardware and, sometimes, a lock. Cabinet doors may be hinged or sliding and may have mirrors on the inner or outer surface. Many cabinet doors are made of glass and have a finished surface, so the stored items can be displayed at the same time. Cabinets can be fabricated from wood; but, increasingly, cabinets are produced using synthetic materials.

Some cabinets are free-standing furnishings, while other cabinets may be built into a wall like a medicine cabinet. Free-standing cabinet furnishings are commonly acquired as separate furnishings, but built-in cabinets are usually custom made for a particular house or home situation. Such built-in cabinets are commonly fixed into their position on a floor, in a wall, or framed in an opening of the home, such as built-in cabinetry found in modern kitchens. Commercial grade cabinets are often called casework.

Before 1650, fine furniture and cabinets were a rarity in Western Europe and North America. For the next century thereafter, many cabinet makers were responsible for the conception and the production of fine cabinet furniture. In the last half of the 18th century, cabinet makers, such as Thomas Sheraton, Thomas Chippendale, Shaver and Wormley Bros. Cabinet Constructors, and George Hepplewhite, published books about different pieces of cabinet furniture. These books were compendiums of their production designs.

With the advent of the industrial revolution, there was an increase in the use of power fabrication and woodworking tools. That led to mass production techniques for furniture production, which led to widespread production and distribution of cabinets. At this time, the traditional cabinet shop ceased to be the main source of cabinet furniture. Cabinet shops and small production facilities focused on the growing demand during this time period for finely made furniture, which was being requested by the rising middle class. This growing demand for finely crafted furnishings eventually resulted in the growth small, specialized professional cabinet makers.

In addition to professional cabinet makers, the arts and craft movement started to take hold in the United Kingdom in the middle of the 19th century, which created a market for traditional cabinets, craft goods, and other craft home furnishings. This arts and craft movement spread to the United States and other countries in the British Empire, which was widely viewed as a reaction to the historicism of the Victorian era. After World War II, woodworking also became a popular hobby among the middle classes, which led to serious and skilled amateurs producing furniture that could rival the work of professional cabinet makers.

Several different design schools for cabinet furniture emerged over time. Furniture and cabinets crafted by Hughes Sambin (1570-1600) possessed double cabinets with a combination of architectural elements and relief carving that is characteristic of French furniture of that period. A Scandinavian school of cabinet design was typified by clean horizontal and vertical lines, and a distinct absence of ornamentation. French provincial cabinet designs are very ornate with stain or paint concealing the wood grains. The corners and bevels of the French provincial cabinet are decorated with gold leaf or gilding, and the flat surfaces on French provincial furnishings are painted with artwork, such as landscapes.

Early American colonial cabinet designs emphasized both form and materials with early American cabinet often being constructed native wood types, such as oak, walnut and mahogany. The rustic style of American cabinet design is typified by very utilitarian features, and these furnishings seek to show the cabinet materials in their natural state. For example, such furnishings may show the original contours of the tree the wood came from, or the contours of the logs or branches with the bark of the tree used in the cabinet construction.

Mission cabinet designs are characterized by straight, thick horizontal and vertical lines and flat panels; and, for early mission cabinetmakers, the material of choice was white oak, which they often darkened through a process known as fuming. Hardware on mission cabinets and furnishings is often visible on the outside of the pieces and made of black iron; and, the Mission style furniture became popular in the early 20th century after being popularized by designers in the arts and craft movement and the art nouveaux movement.

The Asian or Oriental design school for cabinet design is characterized by the use of bamboo and rattan materials, as well as the frequent use of the color red and landscape art. The Shaker cabinet designs are focused on function and symmetry because these furnishing designs were greatly influenced by the Shaker egalitarian religious values and tradition. Such Shaker cabinets are designed to express the utilitarian, functional needs of the community versus the creative expression of any particular cabinet designer.

Most people find storage spaces located in cabinet furnishings to be inadequate for their storage requirements over time because: (1) people usually encounter new needs for more hanging and storage space; and, (2) people usually find it useful to have more storage space than these conventional cabinets can provide over time. Known cabinets possess fixed storage spaces, which does not provide flexibility or adjustability in a storage system.

Thus, a flexible and adjustable storage system for personal items and shoes is needed, as well as a closet organizer that supplements storage space in a cabinet or wardrobe by adding additional storage space and hanging/placement structures. Overall, there is also a need for a space saving device that adds supplemental storage space in a cabinet, organizes shoes and garments to maximize the efficient use of space in a cabinet, and is adjustable to accommodate different sized cabinet, wardrobe or closet spaces.

Shoe Racks and Closet Organizers

Several types of storage organizers, shelving units, and other storage systems are known in the art, and some of them are capable of being arranged and configured in various ways during installation within a storage space, such as a closet. Such known organizers, units, and systems, however, cannot typically be readjusted or rearranged after installation, or adjusted to modify the number, angles, locations and positions of the shelves, racks and hanging elements. Accordingly, conventional storage organizers are not designed or configured to accommodate different types of storage structures, spaces, and accessories depending on the present needs of the user.

Shoe racks have been developed for storing shoes in a convenient manner, such as U.S. Pat. No. 2,682,955 (Moore), which illustrates a reversible shoe rack having a shoe support pivotally mounted to a side frame, and U.S. Pat. No. 4,688,681 (Bergeron), which discloses a foot apparel storage assembly having shelves supported at a base upon a back plate. Additionally, U.S. Pat. No. 1,769,344 (Hoffmire) discloses a portable shoe rack with paddles that extend outwardly from a back brace in a manner to support shoes, and U.S. Pat. No. 2,238,884 (Hoffman) and U.S. Pat. No. 2,090,108 (Cicero) illustrate shoe racks for hanging shoes on a vertical surface.

A primary problem with conventional shoe racks, including the known shoe racks described above, is their inability to prevent shoes from slipping forward, backwards or from side-to-side off the rack without an additional side support member for blocking the shoes, and their inability to support different size shoes, such as heeled shoes and flats. The above-identified prior art shoe racks do not provide adequate support for all sized shoes on a rack, and these known shoe racks and organizers are fixed for a particular storage space, which does not provide flexibility or adjustability in a storage system.

A flexible and adjustable storage system for personal items and shoes is needed, as well as a closet organizer and shoe rack that supplements storage space in a cabinet or wardrobe by adding additional storage space, shoe storage areas, and hanging/placement structures. Overall, there is a need for a shoe rack and storage space saving device that adds supplemental storage space and shoe rack space in a closet or cabinet, organizes shoes and garments to maximize the efficient use of space in a closet or cabinet, and is adjustable to accommodate different sized cabinet, wardrobe or closet spaces. There is also a need for an inexpensive hanging shoe rack having side supporting members and a minimum number of parts, and a shoe rack that allows multiple racks to be suspended from one another.

SUMMARY OF THE INVENTION

The present invention to a compact, adjustable hanging closet organizer and shoe rack that can be re-arranged and expanded in an angular, vertical and lateral direction, as well as modular manner, and the method of making and using same. The present invention seeks to allow for an effective storage and shelf system, and a method of making and using, that supplements storage and shoe rack space in a closet or cabinet, and enhances the efficiency of the user in locating stored items more easily.

The present disclosure is generally related to organizers for storage, and more particularly to an adjustable and reconfigurable organizer system for closets and the like using a plurality of multiple telescoping rods. The present invention storage and shoe rack system includes one or more pairs of horizontal rods where one or more of the rods in the pairs of horizontal rods are affixed to a stationary wall structure, and the spacing between the one or more rods in the rod pairs to the stationary wall being adjustable, and sets of the horizontal rods can be modularly expandable. The pairs of horizontally-oriented rods are rotatable about an axis of rotation, which can be the rod in the pair of rods that is affixed to the stationary wall, and the length of the rod pairs can be adjusted to lengthen or shorten by mated rod units and rod extensions at the end of the rods.

That is, each of the rods in the pairs of horizontal rods is capped at the rod ends and each rod end is extendable lengthwise to widen the reach of the pairs of horizontally oriented rods. Each of rods can be partially covered by an abrasive friction surface, and the rod pairs can support a flat surfaced shelf with a curved upper portion for engaging the upper rod of the rod pair and a lower ledge oriented upward from the lower rod of the rod pair. The flat surfaced shelf can also be partially or completely covered by an abrasive friction surface.

The present invention is directed to a closet organizer and shoe rack that supports the shoes in an inclined manner, such that each shoe is sloped downwardly toward the vertical surface upon which the shoe rack is attached. The angle of the slope is dictated by the angle of the horizontal rods, which is adjustable based on the axis rotation from another rod or the distance set by the lower rod support brace.

The present invention prevents shoes from slipping forward, backwards or from side-to-side off the rack without an additional side support member for blocking the shoes, and the present invention supports the storage of different size shoes, such as heeled shoes and flats. The present invention provides adequate support for all sized shoes on a rack, and the present invention provides a flexible and adjustable storage system for shoes and other personal items.

The present invention contemplates the use of an adhesive element on surfaces, such as a strip of double-sided tape with an abrasive friction surface, or a sand paper or embedded, exposed sanded surface. The rods as modularly stacked can display different colors, and these colors may be coded to specific spacing intervals or heights of the rods in the storage area. The use of the modular stacked pairs of rods allows a vertical extension and retraction of the storage space, while each pair of rods can be extended in the rod pairs and through the use of end extensions laterally from the rod ends.

The present invention provides a flexible and adjustable storage system for personal items and shoes that supplements storage space in a cabinet or wardrobe by adding additional storage space, shoe storage areas, and hanging/placement structures, organizes shoes and garments to maximize the efficient use of space in a closet or cabinet, and provides flexible, adjustable and expandable modular storage to accommodate different sized cabinet, wardrobe or closet spaces. The present invention is economical to manufacture, and it is easy to install, adjust, and use. These and other features, aspects and advantages of the present invention will become better understood with reference to the following drawings, description and claims.

DESCRIPTION OF THE FIGURES

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. The above, and other objects and advantages of the present invention will be understood upon consideration of the following detailed description taken in conjunction with the accompanying drawings, in which like reference characters refer to like parts throughout, and in which.

Figure 1:
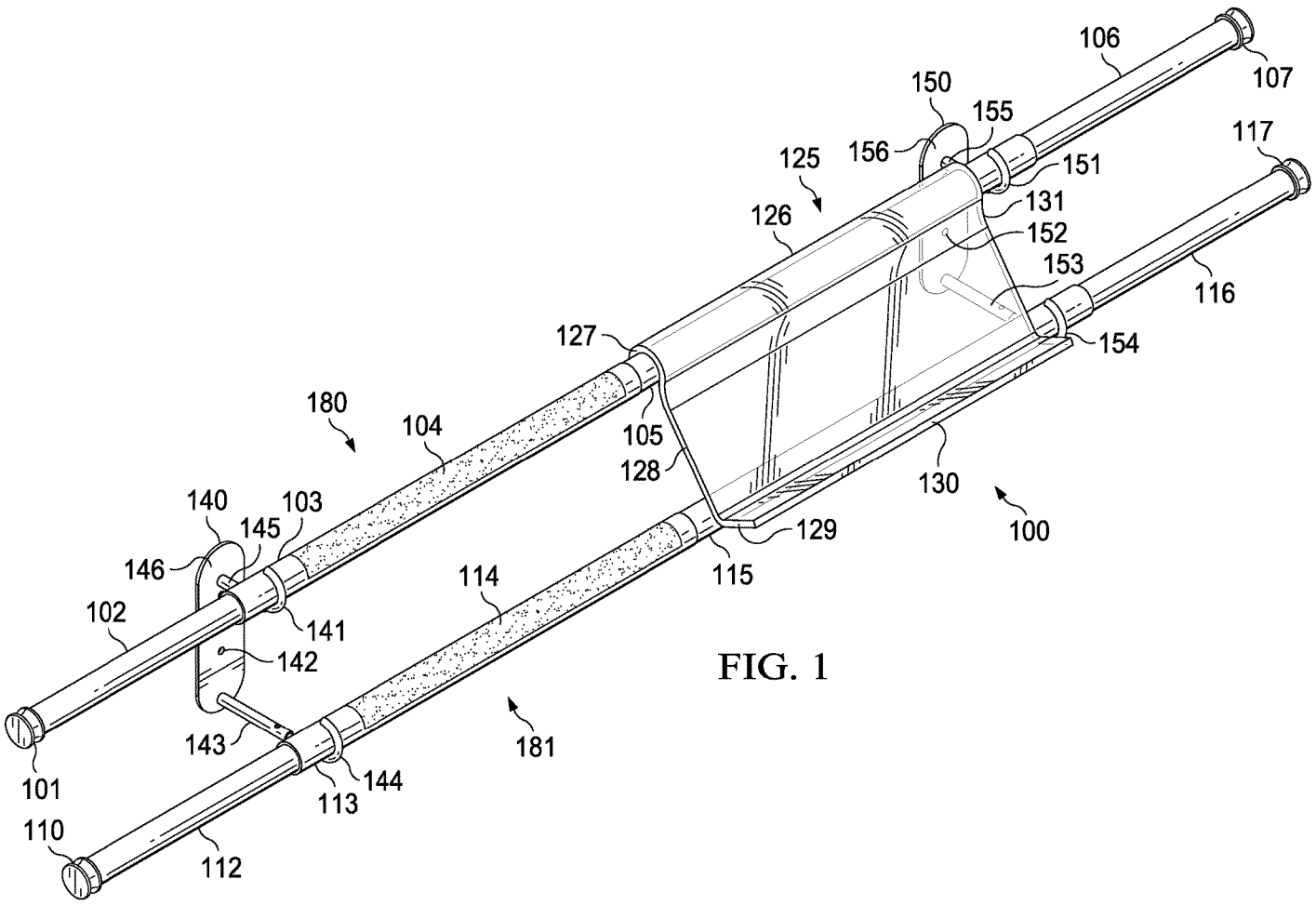
FIG. 1 is a front perspective view of the present invention with independent brackets.

The inventor will use descriptive drawings and text to describe the device and how it functions. While the invention is susceptible to various modifications and alternative forms, specific embodiments thereof have been shown by way of example in the drawings and are herein described in detail. It should be understood that the description herein of specific embodiments is not intended to limit the invention to the particular forms disclosed, but on the contrary, the intention is meant to cover all modifications, equivalents, and alternatives falling within the spirit and scope of the invention as defined by the appended claims.

DETAILED DESCRIPTION

The present invention to a compact and adjustable hanging closet rack and organizer, and the method of making same using a plurality of multiple telescoping rods; and, the present invention includes the features of being a compact, adjustable hanging closet organizer and shoe rack that can be re-arranged and expanded in an angular, vertical and lateral direction, as well as modular manner, and the method of making and using same. The present invention seeks to allow for an effective storage and shelf system, and a method of making and using, that supplements storage and shoe rack space in a closet or cabinet, and enhances the efficiency of the user in locating stored items more easily.

Figure 2:
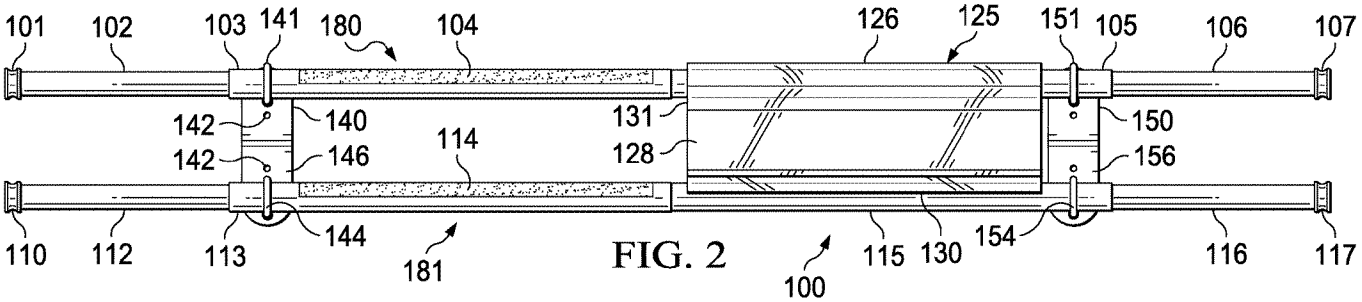
FIG. 2 is a front elevation view of the present invention with independent brackets.
Figure 3:
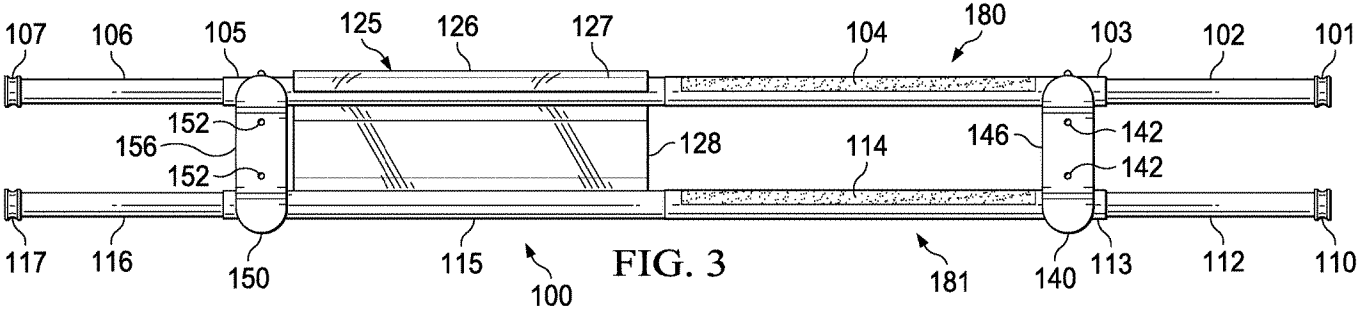
FIG. 3 is a rear elevation view of the present invention with independent brackets.
Figure 5:
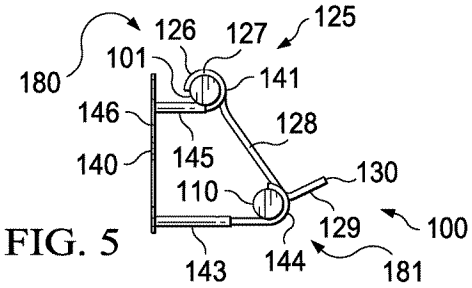
FIG. 5 is a left side view of the present invention with independent brackets.
Figure 4:
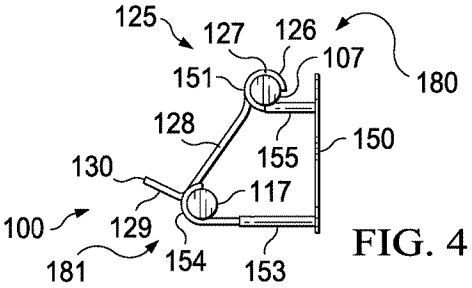
FIG. 4 is a right side view of the present invention with independent brackets.
Figure 6:
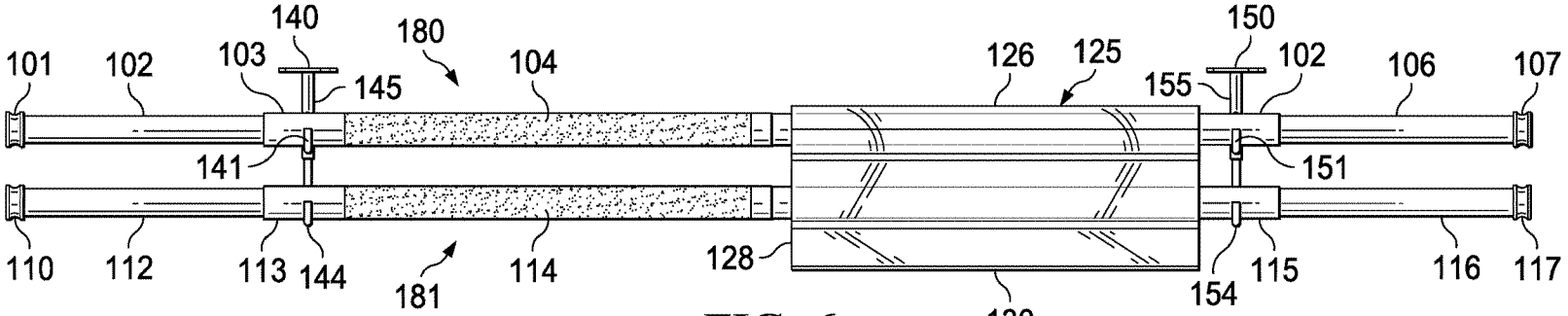
FIG. 6 is a top view of the present invention with independent brackets.
Figure 7:
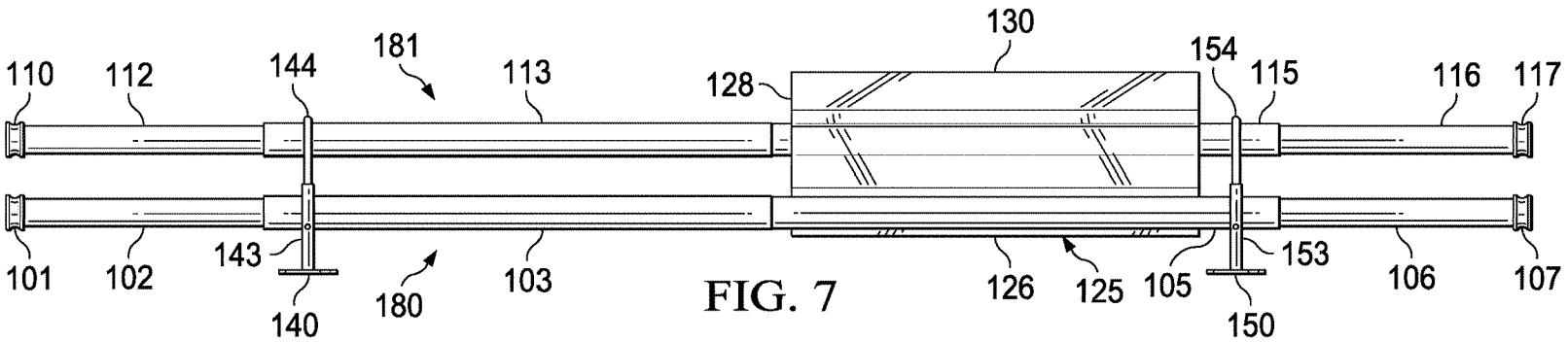
FIG. 7 is a bottom view of the present invention with independent brackets.

The first embodiment of the present invention with independent brackets is shown with FIG. 1 being a front perspective view using independent brackets, FIG. 2 being a front elevation view using independent brackets, FIG. 3 being a rear elevation view using independent brackets, FIG. 4 being a right side view using independent brackets, FIG. 5 being a left side view using independent brackets, FIG. 6 being a top view using independent brackets, and, FIG. 7 being a bottom view of the present invention with independent brackets. As shown in FIGS. 1 to 7, the present invention closet hanger storage device 100 includes a first horizontal rod 180 having a first rod element 103 and a second rod element 105, and a second horizontal rod 181 having a third rod element 113 and a fourth rod element 115.

The first horizontal rod 180 and second horizontal rod 181 each possess a multi-piece telescoping construction with multiple fitted elements working in a highly useful relationship that allows the adjustment of lateral widths of the horizontal rods 180 or 181. For example, in the first horizontal rod 180, the telescoping construction includes a second rod element 105 that has a cylindrical shape and a second circumference that is smaller than the first cylindrical circumference of first rod element 103 that also has a cylindrical shape, such that an interior end of the second rod element 105 fits within the longitudinal circumference of an interior end of the first rod element 103. In that manner, the first rod element 103 and the second rod element 105 in the first horizontal rod 180 can be contracted or expanded lengthwise along their longitudinal axis to accommodate a variable and flexible, desired width in the closet storage area.

In the first horizontal rod 180, the telescoping construction also includes a fifth rod element 102 that has a cylindrical shape and a fifth circumference that is smaller than the first circumference of the first rod element 103 such that an interior end of the fifth rod element 105 fits within the circumference of an exterior end of the first rod element 103. In that manner, the fifth rod element 102 can be extended longitudinally from the exterior end of the first rod element 103 to effectively allow the first horizontal rod 180 to expand longitudinally using the fifth rod element 102 to accommodate a variable and flexible, desired width in the closet storage area. The exterior end of the fifth rod element 102 also possesses an end cap 101 that prevents the fifth rod element 102 from being over-inserted into the inner circumference of exterior end of the first rod element 103, as well as providing a raised, ridged end configuration that prevents articles (e.g. hats, shoes, purses) hung on the fifth rod element 102 from slipping off the end of the fifth rod element 102.

In the first horizontal rod 180, the telescoping construction also includes a sixth rod element 106 that has a cylindrical shape and a sixth circumference that is smaller than the second circumference of the second rod element 105 such that an interior end of the sixth rod element 106 fits within the circumference of an exterior end of the second rod element 105. In that manner, the sixth rod element 106 can be extended longitudinally from the exterior end of the second rod element 105 to effectively allow the first horizontal rod 180 to expand longitudinally using the sixth rod element 106 to accommodate a variable and flexible, desired width in the closet storage area. The exterior end of the sixth rod element 106 also possesses an end cap 107 that prevents the sixth rod element 106 from being over-inserted into the inner circumference of exterior end of the second rod element 105, as well as providing a raised, ridged end configuration that prevents articles (e.g. hats, shoes, purses) hung on the sixth rod element 106 from slipping off the end of the sixth rod element 106.

In the second horizontal rod 181, the telescoping construction includes a fourth rod element 115 that has a cylindrical shape and a fourth circumference that is smaller than the third cylindrical circumference of third rod element 113 that also has a cylindrical shape, such that an interior end of the fourth rod element 115 fits within the longitudinal circumference of an interior end of the third rod element 113. In that manner, the third rod element 113 and the fourth rod element 115 in the second horizontal rod 181 can be contracted or expanded lengthwise along their longitudinal axis to accommodate a variable and flexible, desired width in the closet storage area.

In the second horizontal rod 181, the telescoping construction also includes a seventh rod element 112 that has a cylindrical shape and a seventh circumference that is smaller than the third circumference of the third rod element 113 such that an interior end of the seventh rod element 115 fits within the circumference of an exterior end of the third rod element 113. In that manner, the seventh rod element 112 can be extended longitudinally from the exterior end of the third rod element 113 to effectively allow the second horizontal rod 181 to expand longitudinally using the seventh rod element 112 to accommodate a variable and flexible, desired width in the closet storage area. The exterior end of the seventh rod element 112 also possesses an end cap 110 that prevents the seventh rod element 112 from being over-inserted into the inner circumference of exterior end of the third rod element 113, as well as providing a raised, ridged end configuration that prevents articles (e.g. hats, shoes, purses) hung on the seventh rod element 112 from slipping off the end of the seventh rod element 112.

In the second horizontal rod 181, the telescoping construction also includes an eighth rod element 116 that has a cylindrical shape and an eighth circumference that is smaller than the fourth circumference of the fourth rod element 115 such that an interior end of the eighth rod element 116 fits within the circumference of an exterior end of the fourth rod element 115. In that manner, the eighth rod element 116 can be extended longitudinally from the exterior end of the fourth rod element 115 to effectively allow the second horizontal rod 181 to expand longitudinally using the eighth rod element 116 to accommodate a variable and flexible, desired width in the closet storage area. The exterior end of the eighth rod element 116 also possesses an end cap 117 that prevents the eighth rod element 116 from being over-inserted into the inner circumference of exterior end of the fourth rod element 115, as well as providing a raised, ridged end configuration that prevents articles (e.g. hats, shoes, purses) hung on the eighth rod element 116 from slipping off the end of the eighth rod element 116.

The width of the rods is one of the many features that allows the present invention to be adjusted and modified to suit a particular size and shape of storage area. As described above, the present invention provides a flexible and adjustable storage system for personal items and shoes that supplements storage space in a cabinet or wardrobe by adding additional storage space, shoe storage areas, and hanging/placement structures, organizes shoes and garments to maximize the efficient use of space in a closet or cabinet, and provides flexible, adjustable and expandable modular storage to accommodate different sized cabinet, wardrobe or closet spaces.

In addition to the width of the horizontal rods 180 and 181, the present invention possesses first and second brackets 140 and 150 that support and hold the first horizontal rod 180 and the second horizontal rod 181, respectively, in place by affixing them to a wall interface or vertical planes in the storage areas with first and second bracket plates 146 and 156, respectively, with the brackets 140 and 150 providing variable distances for the first and second horizontal rods 180 and 181 from the wall interface or vertical plane in the storage area, as well as providing a variable angle of inclination between the first horizontal rod 180 and second horizontal rod 181, as well as variable distances between the first horizontal rod 180 and second horizontal rod 181 themselves.

The first bracket 140 possesses a first bracket plate 146 that interfaces with the wall interface or vertical planes in the storage areas by fastener 142. A first bracket arm extension 145 extends outwardly from the wall interface or vertical planes in the storage areas and outwardly from the first bracket plate 146 on the first bracket 140. The first bracket arm extension 145 can be extended and retracted lengthwise and has a first hook 141 that wraps around the first horizontal rod 180 to secure its position on the first bracket 140. The first hook 141 is open-ended to allow the first horizontal rod 180 to be placed on the first bracket 140, but the first horizontal rod 180 can be removed and re-positioned on the first bracket 140 depending on the positioning of the rods in the storage space or the need to position items on the horizontal rods.

The first bracket 140 has a first bracket plate 146 that interfaces with the wall interface or vertical planes in the storage areas, and it also possesses a second bracket arm extension 143 that extends outwardly from the wall interface or vertical planes in the storage areas and outwardly from the first bracket plate 146 on the first bracket 140. The second bracket arm extension 146 can be extended and retracted lengthwise and has a second hook 144 that wraps around the second horizontal rod 181 to secure its position on the first bracket 140. The second hook 144 is open-ended to allow the second horizontal rod 181 to be placed on the first bracket 140, but the second horizontal rod 181 can be removed and re-positioned on the first bracket 140 depending on the positioning of the rods in the storage space or the need to position items on the horizontal rods.

The second bracket 150 possesses a second bracket plate 156 that interfaces with the wall interface or vertical planes in the storage areas by fasteners 152. A third bracket arm extension 155 extends outwardly from the wall interface or vertical planes in the storage areas and outwardly from the second bracket plate 156 on the second bracket 150. The third bracket arm extension 155 can be extended and retracted lengthwise and has a third hook 151 that wraps around the first horizontal rod 180 to secure its position on the second bracket 150. The third hook 151 is open-ended to allow the first horizontal rod 180 to be placed on the second bracket 150, but the first horizontal rod 180 can be removed and re-positioned on the second bracket 150 depending on the positioning of the rods in the storage space or the need to position items on the horizontal rods.

The second bracket 150 has a second bracket plate 156 that interfaces with the wall interface or vertical planes in the storage areas, and it also possesses a fourth bracket arm extension 153 that extends outwardly from the wall interface or vertical planes in the storage areas and outwardly from the second bracket plate 156 on the second bracket 150. The second bracket arm extension 156 can be extended and retracted lengthwise and has a fourth hook 154 that wraps around the second horizontal rod 181 to secure its position on the second bracket 150. The fourth hook 154 is open-ended to allow the second horizontal rod 181 to be placed on the second bracket 150, but the second horizontal rod 181 can be removed and re-positioned on the second bracket 150 depending on the positioning of the rods in the storage space or the need to position items on the horizontal rods.

The ability to extend independently each of the first bracket arm extension 145 and separately the second bracket arm extension 143 outwardly from (or retract to inwardly toward) the first bracket plate 146 and the ability to extend independently each of the third bracket arm extension 155 and separately the fourth bracket arm extension 153 outwardly from (or retract to inwardly toward) the second bracket plate 156 allows the user to flexibly adjust each of the following: (1) the spacing between the first horizontal rod 180 and the first bracket plate 146, the second horizontal rod 181 and the first bracket plate 146, the first horizontal rod 180 and the second bracket plate 156, and the second horizontal rod 181 and the second bracket plate 156; (2) the spacing between the first horizontal rod 180 and the second horizontal rod 181, and (3) the angle of inclination between the first and second horizontal rods 180 and 181.

Moreover, additional sets of horizontal rods 180 and 181 can be modularly stacked vertically up the wall interface or vertical planes in the storage areas, and each pair of horizontal rods can be independently modified and variably adjusted so the spacing in each of the stacked rod pair can be flexibly adjusted between each of the following: (1) the spacing between the first horizontal rod 180 and the first bracket plate 146, the second horizontal rod 181 and the first bracket plate 146, the first horizontal rod 180 and the second bracket plate 156, and the second horizontal rod 181 and the second bracket plate 156; (2) the spacing between the first horizontal rod 180 and the second horizontal rod 181, and (3) the angle of inclination between the first and second horizontal rods 180 and 181. The use of the modular stacked pairs of rods allows a vertical stacked modular storage space with each pair of stacked rod pairs capable of being independently modified and extended as described herein.

The spacing settings on each of the first bracket arm extension 145, second bracket arm extension 143, third bracket arm extension 155, and fourth bracket arm extension 154 can be set so that the horizontal rods 180 and 181 can be placed in parallel with each other and the wall interface or vertical planes in the storage areas. That is, by setting the first bracket arm extension 145 and the third bracket arm extension 155 at substantially the same distances from the first bracket plate 146 and the second bracket plate 156, respectively, the first horizontal rod 180 will be substantially parallel to the wall interface or vertical plane in the storage areas. Also, by setting the second bracket arm extension 143 and the fourth bracket arm extension 153 at substantially the same distances from the first bracket plate 146 and the second bracket plate 156, respectively, the second horizontal rod 181 will be substantially parallel to the wall interface or vertical plane in the storage areas.

When the first horizontal rod 180 and the second horizontal rod 181 are be positioned in parallel to the wall interface or vertical plane in the storage area, these first and second horizontal rods 180 and 181 should be positioned inherently parallel to each other. But, the first and second horizontal rods 180 and 181 can be positioned parallel to each other, but not parallel to the wall interface or vertical plane in the storage area. For example, by setting the first bracket arm extension 145 at a first distance from the first bracket plate 146 and the third bracket arm extension 155 at a third distance from second bracket plate 156, the first and the third distances do not need to be substantially the same. If the first distance is less than the third distance, one end of the first horizontal rod 180 will be located closer to the vertical place or wall interface than the other end of the first horizontal rod 180. If the first distance is greater than the third distance, the opposite end of the first horizontal rod 180 will be located closer to the vertical plane or wall interface than the other end of the first horizontal rod 180.

Likewise, by setting the second bracket arm extension 143 at a second distance from the first bracket plate 146 and the fourth bracket arm extension 153 at a fourth distance from second bracket plate 156, the second and the fourth distances do not need to be substantially the same. If the second distance is less than the fourth distance, one end of the second horizontal rod 181 will be located closer to the vertical place or wall interface than the other end of the second horizontal rod 181. If the second distance is greater than the fourth distance, the opposite end of the second horizontal rod 181 will be located closer to the vertical plane or wall interface than the other end of the first horizontal rod 181.

The first horizontal rod 180 can still be substantially parallel to the position of the second horizontal rod 181 if: (1) the second bracket arm extension 143 is set at a second distance that is proportional (x) to the first distance from the first bracket plate 146, $2^{nd}D=x(1^{st}D$; and, (2) the fourth bracket arm extension 153 is set at a fourth distance that is proportional (y) to the third distance from the second bracket plate 156, $4^{th}D=x(3^{rd}D)$. If x equals y, than the horizontal rods will be parallel to the vertical plane or wall interface. If x does not equal y, than the horizontal rods 180 and 181 will not be parallel to the vertical plane or wall interface, but they may be parallel to each other based on the relationship between x and y.

These different distance settings on the extension arms provide different positioning, spacing, and placement of horizontal rods 180 and 181 in the storage spaces, which will support the placement of different types of items on the horizontal rods 180 and 181. In this manner, the spacing settings on each of the first bracket arm extension 145, second bracket arm extension 143, third bracket arm extension 155, and fourth bracket arm extension 154 can be set so that the horizontal rods 180 and 181 can be independently adjusted to accommodate different positioning and placement of the first and second horizontal rods 180 and 181.

The present invention is also directed to a hanging shoe rack; and, more particularly, the present invention is directed to a hanging shoe rack which supports the shoes in an inclined manner so that the shoes can be visually viewed such that each shoe is sloped downwardly toward the vertical surface upon which the shoe rack is attached. With that inclined display feature in mind, the present invention allows the setting independently for each of the first bracket arm extension 145, second bracket arm extension 143, third bracket arm extension 155, and fourth bracket arm extension 154 so that the angle of inclination between the first and second horizontal rods 180 and 181, which dictates the angle that items are located and placed on the first and second horizontal rods 180 and 181, which can be adjusted and modified.

Specifically, the first bracket arm extension 145 of the first bracket 140 can be extended a shorter distance than the second bracket arm extension 143 of the first bracket 140 so that the first horizontal rod 180 associated with the first bracket arm extension 145 is positioned closer to the wall or vertical surface in the storage area than the position of the second horizontal rod 181 associated with the second bracket arm extension 143. Likewise, the third bracket arm extension 155 of the second bracket 150 can be extended a shorter distance than the fourth bracket arm extension 153 of the second bracket 150 so that the first horizontal rod 180 associated with the third bracket arm extension 155 is positioned closer to the wall or vertical surface in the storage area than the position of the second horizontal rod 181 associated with the fourth bracket arm extension 153. These positions allow the items positioned on the first and second horizontal rods 180 and 181 to be aligned on a plane forming a predetermined angle with respect to vertical so the items may be viewed more easily in their angular inclined placement on the horizontal rods, such as with shoes being placed on the shoe rack and viewed in their angular inclined position placement on the horizontal rods.

By adjusting the spacing settings on each of the first bracket arm extension 145, second bracket arm extension 143, third bracket arm extension 155, and fourth bracket arm extension 154, the spacing between the first and second horizontal rods 180 and 181 can be adjusted to accommodate differing sizes of items and lengths of items, and the spacing of the first and second horizontal rods 180 and 181 can be adjusted to allow the horizontal rods to be more or less extended away from the wall interface or vertical planes in the storage areas. For instance, the spacing and angle of inclination can be independently set by adjusting the spacing settings on each of the first bracket arm extension 145, second bracket arm extension 143, third bracket arm extension 155, and fourth bracket arm extension 154, which can be matched (or not matched) to make the spacing uniform (or not uniform) between the first horizontal rod 180 and the second horizontal rod 181 and its spacing settings on the second bracket 150 and the second bracket plate 156.

The spacing and angle of inclination between the horizontal rods 180 and 181 themselves can be uniform parallel if the first and second brackets 140 and 150 have the same extension arm settings or in an angled alignment if the first and second brackets 140 and 150 have differing extension arm settings on each of the first bracket arm extension 145, second bracket arm extension 143, third bracket arm extension 155, and fourth bracket arm extension 154.

The present embodiment of the invention also contemplates the use of a first abrasive surface 104 or first abrasive coating 104 placed partially or completely around the surface of the first horizontal rod 180 and/or a second abrasive surface 114 or second abrasive coating 114 on the surface of the second horizontal rod 181. Locking clips and brackets can also be positioned on the first or second horizontal rods 180 and 181 so that other items can be placed or hung from the horizontal rods. The abrasive surfaces 104 or 114 can include a double sided tape, or strip of sand paper or embedded sand/granules embedded in the first surface 104, the first coating 104, the second surface 114, or the second surface 114.

The first abrasive surface 104 or first abrasive coating 104 surrounds the first horizontal rod 180 so that items placed on the surface of the first horizontal rod 180 are held securely upon and do not slip off the first horizontal rod 180. The second abrasive surface 114 or second abrasive coating 114 surrounds the second horizontal rod 181 so that items placed on the surface of the second horizontal rod 181 are held securely upon and do not slip off the second horizontal rod 181. These abrasive surfaces prevents shoes from slipping forward, backwards or from side-to-side off the horizontal rods 180 and 181 without an additional side support members; and, the present invention supports the storage of different size shoes, such as heeled shoes and flats, supports the storage of all sized shoes on a rack, and provides a flexible and adjustable storage system for shoes and other personal items.

A shelf 125 can be laid on the top surface of the first horizontal rod 180 and second horizontal rod 181 with the shelf 125 being composed on an acrylic or clear plastic (or other suitable material or coloration). The top portion 126 of the shelf 125 has a curved upper rounded securing edge 127 that wraps around the first horizontal rod allowing the shelf 125 to be rotated radially around the first horizontal rod 180 as its axis of rotation. Below the rounded securing edge 127, the shelf extends downwardly from the first horizontal rod 180 with a curved flat surface 131 coupled to a flat surface 128, which extends to the second horizontal rod 181. The shelf 125 extends further downwardly across the top surface of the second horizontal rod 181 with an upwardly extending ledge 129 having a lower lip 130 that prevent items or pieces placed on the shelf 125 from slipping off the shelf 125.

Figure 8:
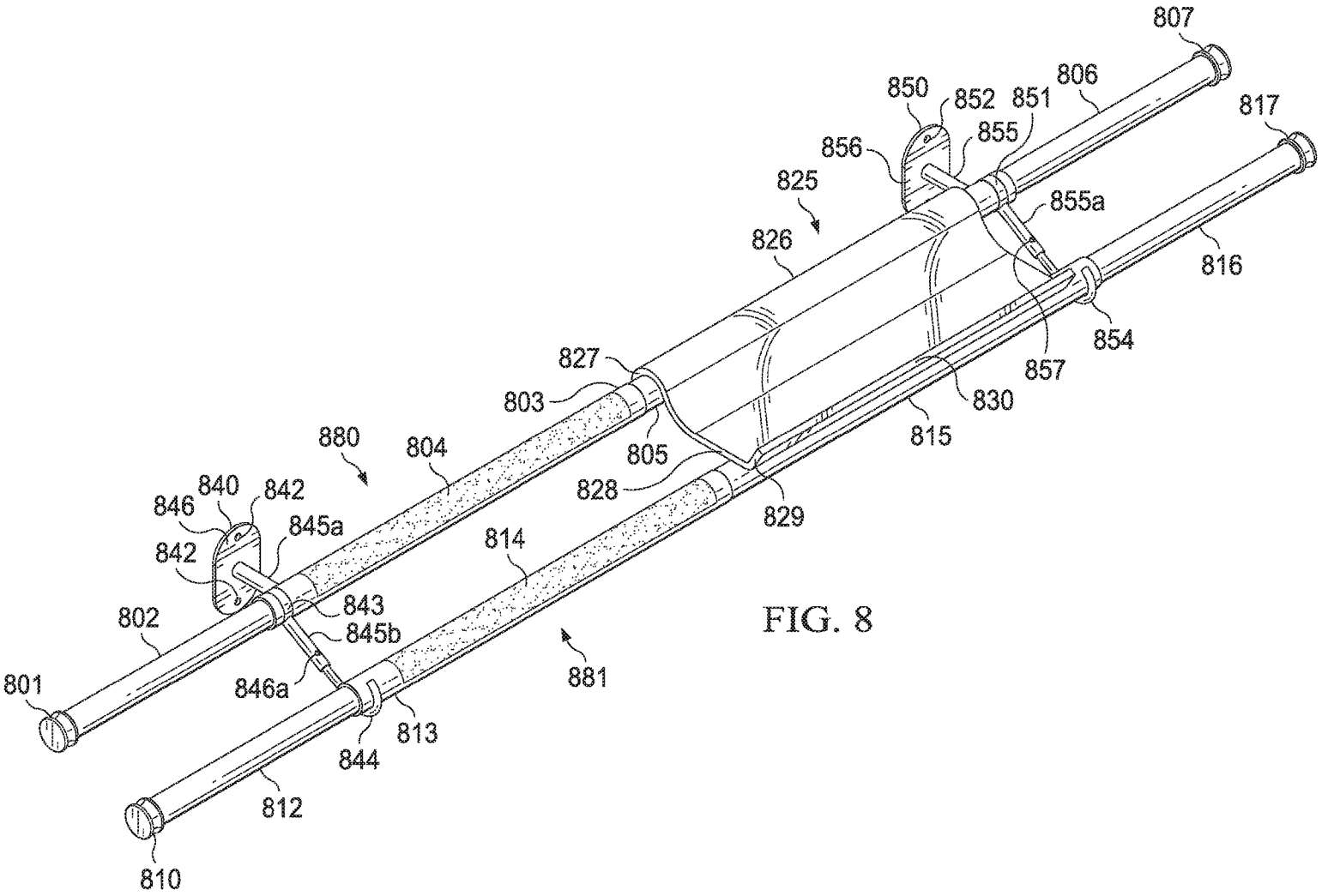
FIG. 8 is a front perspective view of the present invention with coupled brackets.
Figure 9:
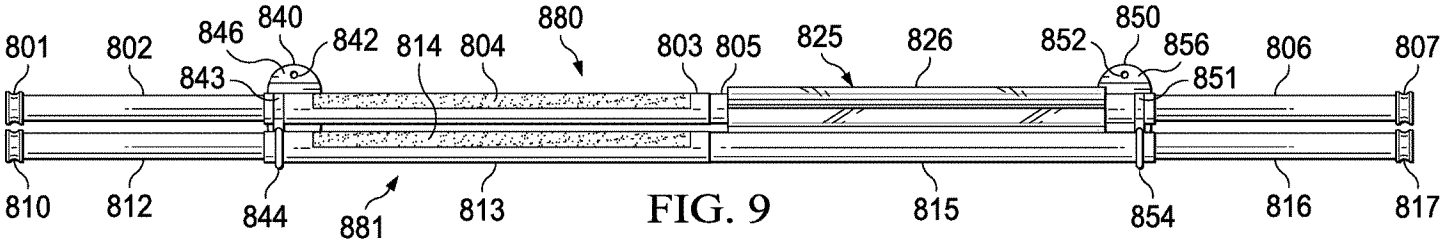
FIG. 9 is a front elevation view of the present invention with coupled brackets.
Figure 10:
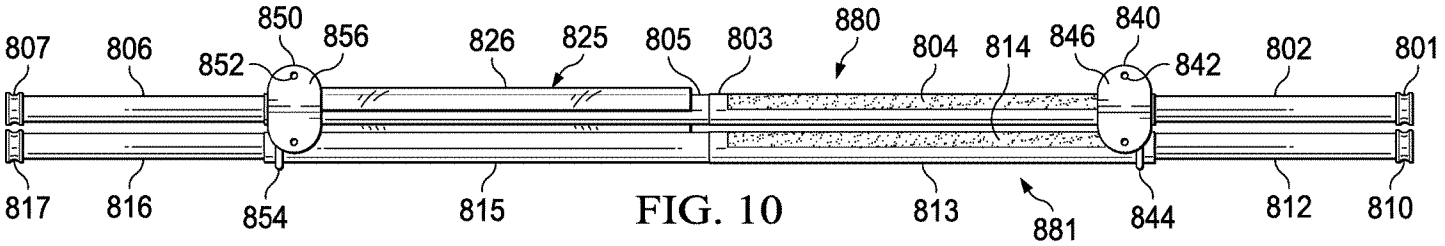
FIG. 10 is a rear elevation view of the present invention with coupled brackets.
Figure 12:
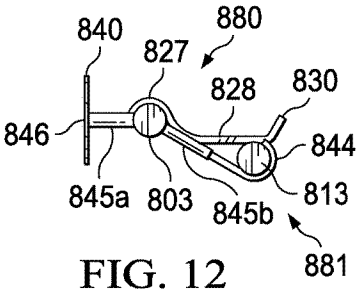
FIG. 12 is a left side view of the present invention with coupled brackets.
Figure 11:
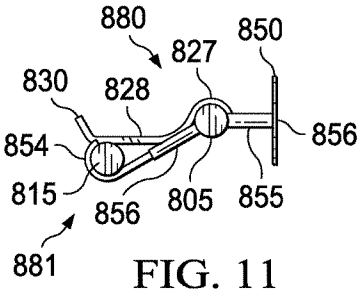
FIG. 11 is a right side view of the present invention with coupled brackets.
Figure 13:
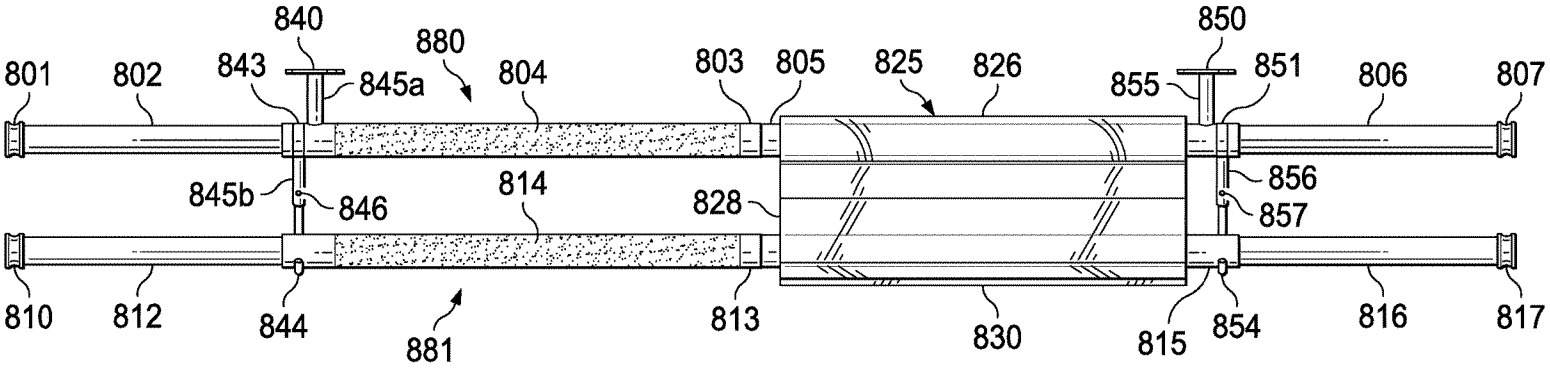
FIG. 13 is a top view of the present invention with coupled brackets.
Figure 14:
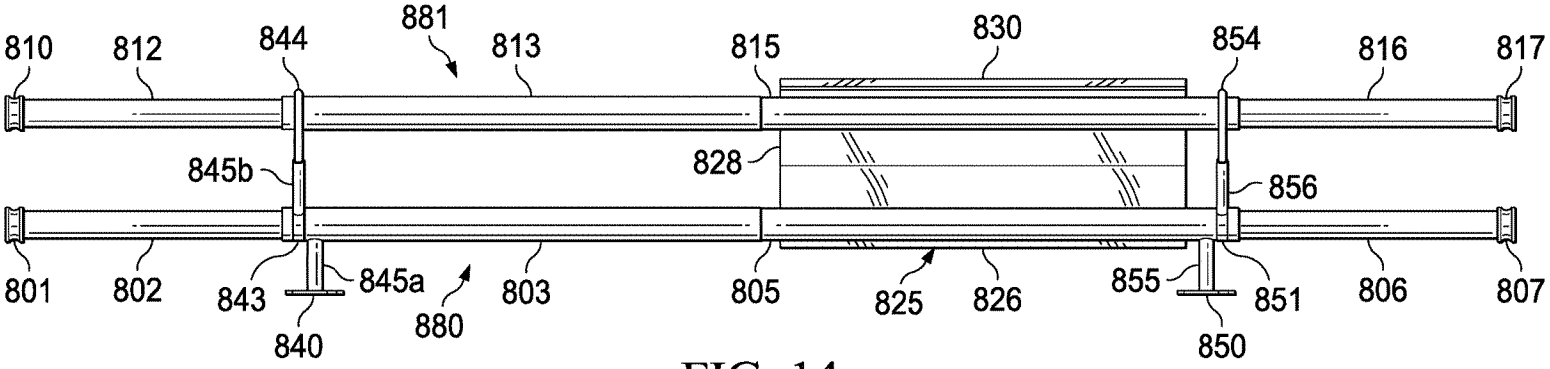
FIG. 14 is a bottom view of the present invention with coupled brackets.

The second embodiment of the present invention with coupled brackets is shown with FIG. 8 being a front perspective view using coupled brackets, FIG. 9 being a front elevation view using coupled brackets, FIG. 10 being a rear elevation view using coupled brackets, FIG. 11 being a right side view using coupled brackets, FIG. 12 being a left side view using coupled brackets, FIG. 13 being a top view using coupled brackets, and, FIG. 14 being a bottom view of the present invention with coupled brackets. As shown in FIGS. 8 to 14, the present invention closet hanger storage device 800 includes a first horizontal rod 880 having a first rod element 803 and a second rod element 805, and a second horizontal rod 881 having a third rod element 813 and a fourth rod element 815.

The first horizontal rod 880 and second horizontal rod 881 each possess a multi-piece telescoping construction with multiple fitted elements working in a highly useful relationship that allows the adjustment of lateral widths of the horizontal rods 880 or 881. For example, in the first horizontal rod 880, the telescoping construction includes a second rod element 805 that has a cylindrical shape and a second circumference that is smaller than the first cylindrical circumference of first rod element 803 that also has a cylindrical shape, such that an interior end of the second rod element 805 fits within the longitudinal circumference of an interior end of the first rod element 803. In that manner, the first rod element 803 and the second rod element 805 in the first horizontal rod 880 can be contracted or expanded lengthwise along their longitudinal axis to accommodate a variable and flexible, desired width in the closet storage area.

In the first horizontal rod 880, the telescoping construction also includes a fifth rod element 802 that has a cylindrical shape and a fifth circumference that is smaller than the first circumference of the first rod element 803 such that an interior end of the fifth rod element 805 fits within the circumference of an exterior end of the first rod element 803. In that manner, the fifth rod element 802 can be extended longitudinally from the exterior end of the first rod element 803 to effectively allow the first horizontal rod 880 to expand longitudinally using the fifth rod element 802 to accommodate a variable and flexible, desired width in the closet storage area. The exterior end of the fifth rod element 802 also possesses an end cap 801 that prevents the fifth rod element 802 from being over-inserted into the inner circumference of exterior end of the first rod element 803, as well as providing a raised, ridged end configuration that prevents articles (e.g. hats, shoes, purses) hung on the fifth rod element 802 from slipping off the end of the fifth rod element 802.

In the first horizontal rod 880, the telescoping construction also includes a sixth rod element 806 that has a cylindrical shape and a sixth circumference that is smaller than the second circumference of the second rod element 805 such that an interior end of the sixth rod element 806 fits within the circumference of an exterior end of the second rod element 805. In that manner, the sixth rod element 806 can be extended longitudinally from the exterior end of the second rod element 805 to effectively allow the first horizontal rod 880 to expand longitudinally using the sixth rod element 806 to accommodate a variable and flexible, desired width in the closet storage area. The exterior end of the sixth rod element 806 also possesses an end cap 807 that prevents the sixth rod element 806 from being over-inserted into the inner circumference of exterior end of the second rod element 805, as well as providing a raised, ridged end configuration that prevents articles (e.g. hats, shoes, purses) hung on the sixth rod element 806 from slipping off the end of the sixth rod element 806.

In the second horizontal rod 881, the telescoping construction includes a fourth rod element 815 that has a cylindrical shape and a fourth circumference that is smaller than the third cylindrical circumference of third rod element 813 that also has a cylindrical shape, such that an interior end of the fourth rod element 815 fits within the longitudinal circumference of an interior end of the third rod element 813. In that manner, the third rod element 813 and the fourth rod element 815 in the second horizontal rod 881 can be contracted or expanded lengthwise along their longitudinal axis to accommodate a variable and flexible, desired width in the closet storage area.

In the second horizontal rod 881, the telescoping construction also includes a seventh rod element 812 that has a cylindrical shape and a seventh circumference that is smaller than the third circumference of the third rod element 813 such that an interior end of the seventh rod element 815 fits within the circumference of an exterior end of the third rod element 813. In that manner, the seventh rod element 812 can be extended longitudinally from the exterior end of the third rod element 813 to effectively allow the second horizontal rod 881 to expand longitudinally using the seventh rod element 812 to accommodate a variable and flexible, desired width in the closet storage area. The exterior end of the seventh rod element 812 also possesses an end cap 810 that prevents the seventh rod element 812 from being over-inserted into the inner circumference of exterior end of the third rod element 813, as well as providing a raised, ridged end configuration that prevents articles (e.g. hats, shoes, purses) hung on the seventh rod element 812 from slipping off the end of the seventh rod element 812.

In the second horizontal rod 881, the telescoping construction also includes an eighth rod element 816 that has a cylindrical shape and an eighth circumference that is smaller than the fourth circumference of the fourth rod element 815 such that an interior end of the eighth rod element 816 fits within the circumference of an exterior end of the fourth rod element 815. In that manner, the eighth rod element 816 can be extended longitudinally from the exterior end of the fourth rod element 815 to effectively allow the second horizontal rod 881 to expand longitudinally using the eighth rod element 816 to accommodate a variable and flexible, desired width in the closet storage area. The exterior end of the eighth rod element 816 also possesses an end cap 817 that prevents the eighth rod element 816 from being over-inserted into the inner circumference of exterior end of the fourth rod element 815, as well as providing a raised, ridged end configuration that prevents articles (e.g. hats, shoes, purses) hung on the eighth rod element 816 from slipping off the end of the eighth rod element 816.

The width of the rods is one of the many features that allows the present invention to be adjusted and modified to suit a particular size and shape of storage area. As described above, the present invention provides a flexible and adjustable storage system for personal items and shoes that supplements storage space in a cabinet or wardrobe by adding additional storage space, shoe storage areas, and hanging/placement structures, organizes shoes and garments to maximize the efficient use of space in a closet or cabinet, and provides flexible, adjustable and expandable modular storage to accommodate different sized cabinet, wardrobe or closet spaces.

In addition to the width of the horizontal rods 880 and 881, the present invention possesses first and second brackets 840 and 850 that support and hold the first horizontal rod 880 and the second horizontal rod 881, respectively, in place by affixing them to a wall interface or vertical planes in the storage areas with first and second bracket plates 846 and 856, respectively, with the brackets 840 and 850 providing variable distances for the first and second horizontal rods 880 and 881 from the wall interface or vertical plane in the storage area, as well as providing a variable angle of inclination between the first horizontal rod 880 and second horizontal rod 881, as well as variable distances between the first horizontal rod 880 and second horizontal rod 881 themselves.

The first bracket 840 possesses a first bracket plate 846 that interfaces with the wall interface or vertical planes in the storage areas by fastener 842. A first bracket arm extension 845*a* extends outwardly from the wall interface or vertical planes in the storage areas and outwardly from the first bracket plate 846 on the first bracket 840. The first bracket arm extension 845*a* can be extended and retracted lengthwise and has a first loop 843 that wraps around the first horizontal rod 880 to secure its position on the first bracket 840.

The first loop 843 is closed-ended to secure the first horizontal rod 880 to be placed on the first bracket 840, while the first loop 843 has a second bracket arm extension 845*b* that extends outwardly from the first loop 843. The second bracket arm extension 845*b* can be radially rotated around the axis defined by the first loop 843 and the first horizontal rod 180 and the second bracket arm extension 845*b* can extended and retracted lengthwise from the first loop 843 with a first locking button 846*a*. The second bracket arm extension 845*b* has a second hook 844 that wraps around the second horizontal rod 881 to secure its position on the first bracket 840. The second hook 844 is open-ended to allow the second horizontal rod 881 to be removed and re-positioned on the first bracket 840 depending on the positioning of the rods in the storage space or the need to position items on the horizontal rods and its rotational position relative to the first horizontal rod 880 set by the first loop 843.

The second bracket 850 possesses a second bracket plate 856 that interfaces with the wall interface or vertical planes in the storage areas by fasteners 852. A third bracket arm extension 855 extends outwardly from the wall interface or vertical planes in the storage areas and outwardly from the second bracket plate 856 on the second bracket 850. The third bracket arm extension 855 can be extended and retracted lengthwise and has a second loop 851 that wraps around the first horizontal rod 880 to secure its position on the second bracket 850.

The second loop 851 is closed-ended to secure the first horizontal rod 880 to be placed on the second bracket 850, while the second loop 851 has a fourth bracket arm extension 856 that extends outwardly from the second loop 851. The fourth bracket arm extension 856 can be radially rotated around the axis defined by the second loop 851 and the first horizontal rod 180 and the fourth bracket arm extension 856 can extended and retracted lengthwise from the second loop 851 with a second locking button 857. The fourth bracket arm extension 855*a* has a fourth hook 854 that wraps around the second horizontal rod 881 to secure its position on the second bracket 850. The fourth hook 854 is open-ended to allow the second horizontal rod 881 to be removed and re-positioned on the second bracket 840 depending on the positioning of the rods in the storage space or the need to position items on the horizontal rods and its rotational position relative to the first horizontal rod 880 set by the second loop 851.

The ability to extend independently the first bracket arm extension 845*a* and separately extend/retract and rotate the second bracket arm extension 845*b* outwardly from (or retract to inwardly toward) the first loop 843 allows the user to flexibly adjust each of the following: (1) the spacing between the first horizontal rod 880 and the first bracket plate 846; (2) the spacing between the first horizontal rod 880 and the second horizontal rod 881, and (3) the angle of inclination between the first and second horizontal rods 880 and 881. Moreover, the ability to extend independently the third bracket arm extension 855 and separately extend/retract and rotate the fourth bracket arm extension 856 outwardly from (or retract to inwardly toward) the second loop 843 allows the user to flexibly adjust each of the following: (1) the spacing between the first horizontal rod 880 and the second bracket plate 856; (2) the spacing between the first horizontal rod 880 and the second horizontal rod 881, and (3) the angle of inclination between the first and second horizontal rods 880 and 881.

Moreover, additional sets of horizontal rods 880 and 881 can be modularly stacked vertically up the wall interface or vertical planes in the storage areas, and each pair of horizontal rods can be independently modified and variably adjusted so the spacing in each of the stacked rod pair can be flexibly adjusted between each of the following: (1) the spacing between the first horizontal rod 880 and the first bracket plate 846 and the first horizontal rod 880 and the second bracket plate 856; (2) the spacing between the first horizontal rod 880 and the second horizontal rod 881, and (3) the angle of inclination between the first and second horizontal rods 880 and 881. The use of the modular stacked pairs of rods allows a vertical stacked modular storage space with each pair of stacked rod pairs capable of being independently modified and extended as described herein.

The spacing settings on each of the first bracket arm extension 845*a*, second bracket arm extension 845*b*, third bracket arm extension 855, and fourth bracket arm extension 856 can be set so that the horizontal rods 880 and 881 can be placed in parallel with each other and the wall interface or vertical planes in the storage areas. That is, by setting the first bracket arm extension 845*a* and the third bracket arm extension 855 at substantially the same distances from the first bracket plate 846 and the second bracket plate 856, respectively, the first horizontal rod 880 will be substantially parallel to the wall interface or vertical plane in the storage areas. Also, by setting the second bracket arm extension 845*b* and the fourth bracket arm extension 856 at substantially the same distances from the first loop 843 and the second loop 851 and at the same rotational angle of inclination from the loops 843 and 851, respectively, the second horizontal rod 881 will be substantially parallel to the wall interface or vertical plane in the storage areas.

When the first horizontal rod 880 and the second horizontal rod 881 are be positioned in parallel to the wall interface or vertical plane in the storage area, these first and second horizontal rods 880 and 881 should be positioned inherently parallel to each other. But, the first and second horizontal rods 880 and 881 can be positioned parallel to each other, but not parallel to the wall interface or vertical plane in the storage area. For example, by setting the first bracket arm extension 845*a* at a first distance from the first bracket plate 846 and the third bracket arm extension 855 at a third distance from second bracket plate 856, the first and the third distances do not need to be substantially the same. If the first distance is less than the third distance, one end of the first horizontal rod 880 will be located closer to the vertical place or wall interface than the other end of the first horizontal rod 880. If the first distance is greater than the third distance, the opposite end of the first horizontal rod 880 will be located closer to the vertical plane or wall interface than the other end of the first horizontal rod 880.

Likewise, by setting the second bracket arm extension 845*b* at a second distance from the first loop 843 or rotating it to a first angle of inclination, and by setting the fourth bracket arm extension 856 at a fourth distance from second loop 851 or rotating it to a second angle of inclination, the second and the fourth distances do not need to be substantially the same and/or the first and second angles of inclination need not be substantially the same. If the second distance is less than the fourth distance, one end of the second horizontal rod 881 will be located closer to the vertical place or wall interface than the other end of the second horizontal rod 881. If the second distance is greater than the fourth distance, the opposite end of the second horizontal rod 881 will be located closer to the vertical plane or wall interface than the other end of the first horizontal rod 881. Likewise, the first and second angles of inclination can be set to make one end of the second horizontal rod 881 closer or further away from the vertical plane or wall interface.

These different distance settings on the extension arms provide different positioning, spacing, and placement of horizontal rods 880 and 881 in the storage spaces, which will support the placement of different types of items on the horizontal rods 880 and 881. In this manner, the spacing settings on each of the first bracket arm extension 845*a*, second bracket arm extension 845*b*, third bracket arm extension 855, and fourth bracket arm extension 856 can be set so that the horizontal rods 880 and 881 can be independently adjusted to accommodate different positioning and placement of the first and second horizontal rods 880 and 881.

The present invention is also directed to a hanging shoe rack; and, more particularly, the present invention is directed to a hanging shoe rack which supports the shoes in an inclined manner so that the shoes can be visually viewed such that each shoe is sloped downwardly toward the vertical surface upon which the shoe rack is attached. With that inclined display feature in mind, the present invention allows the setting independently for each of the first bracket arm extension 845*a*, second bracket arm extension 845*b*, third bracket arm extension 855, and fourth bracket arm extension 856 along with the setting of the first and second angles of inclination for the second bracket arm extension 845*b* and the fourth bracket arm extension 856, respectively, so as to set the angle of inclination between the first and second horizontal rods 880 and 881, which dictates the angle that items are located and placed on the first and second horizontal rods 880 and 881, which can be adjusted and modified.

Each of the bracket arm extensions 845*a*, 845*b*, 855, and 856 can be extended and retracted, and the second and fourth bracket arm extensions 845*b* and 856 can be rotated radially around the axis defined by the first horizontal rod 880 or the first and second loops 843 and 851 to position the first and second horizontal rods 880 and 881 to be aligned on a plane forming a predetermined angle with respect to vertical so the items may be viewed more easily in their angular inclined placement on the horizontal rods, such as with shoes being placed on the shoe rack and viewed in their angular inclined position placement on the horizontal rods.

By adjusting the spacing and rotational settings the first bracket arm extension 845*a*, second bracket arm extension 845*b*, third bracket arm extension 855, and fourth bracket arm extension 856, the spacing between the first and second horizontal rods 880 and 881 can be adjusted to accommodate differing sizes of items and lengths of items, and the spacing of the first and second horizontal rods 880 and 881 can be adjusted to allow the horizontal rods to be more or less extended away from the wall interface or vertical planes in the storage areas. For instance, the spacing and angle of inclination can be independently set by adjusting the spacing and rotational settings on each of the first bracket arm extension 845*a*, second bracket arm extension 845*b*, third bracket arm extension 855, and fourth bracket arm extension 856, which can be matched (or not matched) to make the spacing uniform (or not uniform) between the first horizontal rod 880 and the second horizontal rod 881 and its spacing settings on the second bracket 850 and the second bracket plate 856.

The spacing and angle of inclination between the horizontal rods 880 and 881 themselves can be uniform parallel if the first and second brackets 840 and 850 have the same extension arm settings or in an angled alignment if the first and second brackets 840 and 850 have differing extension arm settings on each of the first bracket arm extension 845*a*, second bracket arm extension 845*b*, third bracket arm extension 855, and fourth bracket arm extension 856.

The present embodiment of the invention also contemplates the use of a first abrasive surface 804 or first abrasive coating 804 placed partially or completely around the surface of the first horizontal rod 880 and/or a second abrasive surface 814 or second abrasive coating 814 on the surface of the second horizontal rod 881. Locking clips and brackets can also be positioned on the first or second horizontal rods 880 and 881 so that other items can be placed or hung from the horizontal rods. The abrasive surfaces 804 or 814 can include a double sided tape, or strip of sand paper or embedded sand/granules embedded in the first surface 804, the first coating 804, the second surface 814, or the second coating 814.

The first abrasive surface 804 or first abrasive coating 804 surrounds the first horizontal rod 880 so that items placed on the surface of the first horizontal rod 880 are held securely upon and do not slip off the first horizontal rod 880. The second abrasive surface 814 or second abrasive coating 814 surrounds the second horizontal rod 881 so that items placed on the surface of the second horizontal rod 881 are held securely upon and do not slip off the second horizontal rod 881. These abrasive surfaces prevents shoes from slipping forward, backwards or from side-to-side off the horizontal rods 880 and 881 without an additional side support members; and, the present invention supports the storage of different size shoes, such as heeled shoes and flats, supports the storage of all sized shoes on a rack, and provides a flexible and adjustable storage system for shoes and other personal items.

A shelf 825 can be laid on the top surface of the first horizontal rod 880 and second horizontal rod 881 with the shelf 825 being composed on an acrylic or clear plastic (or other suitable material or coloration). The top portion 826 of the shelf 825 has a curved upper rounded securing edge 827 that wraps around the first horizontal rod allowing the shelf 825 to be rotated radially around the first horizontal rod 880 as its axis of rotation. Below the rounded securing edge 827, the shelf extends downwardly from the first horizontal rod 880 with a curved flat surface 831 coupled to a flat surface 828, which extends to the second horizontal rod 881. The shelf 825 extends further downwardly across the top surface of the second horizontal rod 881 with an upwardly extending ledge 829 having a lower lip 830 that prevent items or pieces placed on the shelf 825 from slipping off the shelf 825.

Additionally, the storage system in the first and second embodiments of the present invention can include modular stacked horizontal rod pairs, including stacked horizontal rod pairs that are suspended from one another. Although certain organizer systems and methods have been disclosed and described herein in accordance with the teachings of the present disclosure; the scope of coverage of this patent is not limited thereto. While the present invention has been described in terms of particular embodiments and applications, in both summarized and detailed forms, it is not intended that these descriptions in any way limit its scope to any such embodiments and applications, and it will be understood that variations in the described embodiment of the method and system illustrated herein and of their operation can be made without departing from the spirit of this invention. It should be understood, of course, that the foregoing relates to exemplary embodiments of the invention and that modifications may be made without departing from the spirit and scope of the invention as set forth in the following claims.

What is claimed is:

1. A closet storage system comprising:

(a) a first telescopic horizontal rod that can be contracted or expanded lengthwise along its longitudinal axis, said first telescopic horizontal rod having:

a first rod element having a cylindrical shape with a first circumference, an interior end, and an exterior end, a second rod element having an interior end, an exterior end, and a cylindrical shape with a second circumference that is smaller than the first circumference of the first rod element such that the interior end of the second rod element fits within the circumference of the interior end of the first rod element, wherein said first telescopic horizontal rod can be contracted or expanded lengthwise along its longitudinal axis using the first rod element and the second rod element to accommodate a variable width in a closet storage area;

a fifth rod element having an interior end, an exterior end, and a cylindrical shape with a fifth circumference that is smaller than the first circumference of the first rod element such that the interior end of the fifth rod element fits within the circumference of the exterior end of the first rod element, said first telescopic horizontal rod being extendable longitudinally from the exterior end of the first rod element using the fifth rod element to accommodate a variable width in the closet storage area, a first end cap placed on said exterior end of the fifth rod element that prevents the entire fifth rod element from being completely inserted within the circumference of the first rod element and provides a raised end that prevents articles hung on the fifth rod element from unintentionally slipping off the exterior end of the fifth rod element;

a sixth rod element having an interior end, an exterior end, a cylindrical shape with a sixth circumference that is smaller than the second circumference of the second rod element such that the interior end of the sixth rod element fits within the circumference of the exterior end of the second rod element, said first telescopic horizontal rod being extendable longitudinally from the exterior end of the second rod element by sliding said sixth rod element to accommodate a variable width in the closet storage area; and, a second end cap placed on said exterior end of the sixth rod element that prevents the entire sixth rod element from being completely inserted within the circumference of the second rod element and provides a raised end that prevents articles hung on the sixth rod element from unintentionally slipping off the exterior end of the sixth rod element;

(b) a second telescopic horizontal rod that can be contracted or expanded lengthwise along its longitudinal axis, said second telescopic horizontal rod having:

a third rod element having a cylindrical shape with a third circumference, an interior end, and an exterior end, a fourth rod element having an interior end, an exterior end, and a cylindrical shape with a fourth circumference that is smaller than the third circumference of the third rod element such that the interior end of the fourth rod element fits within the circumference of an interior end of the third rod element, wherein said second telescopic horizontal rod can be contracted or expanded lengthwise along its longitudinal axis using the third rod element and the fourth rod element to accommodate a variable width in the closet storage area;

a seventh rod element having an interior end, an exterior end, and a cylindrical shape with a seventh circumference that is smaller than the third circumference of the third rod element such that the interior end of the seventh rod element fits within the circumference of the exterior end of the third rod element, said second telescopic horizontal rod being extendable longitudinally from the exterior end of the third rod element by sliding the seventh rod element to accommodate a variable width in the closet storage area, a third end cap placed on said exterior end of the seventh rod element that prevents the entire seventh rod element from being completely inserted within the circumference of the third rod element and provides a raised end that prevents articles hung on the seventh rod element from unintentionally slipping off the exterior end of the seventh rod element;

an eighth rod element having an interior end, an exterior end, and a cylindrical shape with an eighth circumference that is smaller than the fourth circumference of the fourth rod element such that the interior end of the eighth rod element fits within the circumference of the exterior end of the fourth rod element, said second telescopic horizontal rod being extendable longitudinally from the exterior end of the fourth rod element by sliding said eighth rod element to accommodate a variable width in the closet storage area; and, a fourth end cap placed on said exterior end of the eighth rod element that prevents the entire eighth rod element from being completely inserted within the circumference of the fourth rod element and provides a raised end that prevents articles hung on the eighth rod element from unintentionally slipping off the exterior end of the eighth rod element;

(c) a first bracket having a first bracket plate, a first bracket arm extension, and a second bracket arm extension, wherein the first bracket supports the first and second telescopic horizontal rods and fastens said first and second telescopic horizontal rods to a vertical wall of the closet storage area; the first and second bracket arm extensions of said first bracket adjustably setting: (i) the distances for the first and second telescopic horizontal rods from the first bracket plate, (ii) the angle of inclination between the first telescopic horizontal rod and the second telescopic horizontal rod relative to the first bracket plate, and (iii) the distances between the first telescopic horizontal rod and the second telescopic horizontal rod;

said first bracket arm extension being adjustably extendable outwardly from the first bracket plate of the first bracket, said first bracket arm extension securing a position of said first telescopic horizontal rod on the first bracket;

said second bracket arm extension having a second hook that wraps around the second telescopic horizontal rod to secure a position of said second telescopic horizontal rod on the first bracket, said second hook being open-ended to allow the second telescopic horizontal rod to be placed and removably repositioned on the first bracket; and, (d) a second bracket having a second bracket plate, a third bracket arm extension, and a fourth bracket arm extension, wherein the second bracket supports the first and second telescopic horizontal rods and fastens said first and second telescopic horizontal rods to the vertical wall of the closet storage area; the third and fourth bracket arm extensions of said second bracket adjustably setting: (i) the distances for the first and second telescopic horizontal rods from the second bracket plate, (ii) the angle of inclination between the first telescopic horizontal rod and the second telescopic horizontal rod relative to the second bracket plate, and (iii) the distances between the first telescopic horizontal rod and the second telescopic horizontal rod;

said third bracket arm extension being adjustably extendable outwardly from the second bracket plate of the second bracket, said third bracket arm extension securing the position of said first telescopic horizontal rod on the second bracket, said fourth bracket arm extension having a fourth hook that wraps around the second telescopic horizontal rod to secure the position of said second telescopic horizontal rod on the second bracket, said fourth hook being open-ended to allow the second telescopic horizontal rod to be placed and removably repositioned on the second bracket;

wherein said first and second telescopic horizontal rods can be positioned to store items in an inclined manner with the first telescopic horizontal rod positioned above said second telescopic horizontal rod so that said items can be viewed in a downwardly sloping manner when placed on the first and second telescopic horizontal rods, and, (e) one or more abrasive surfaces on a top surface of the first or second telescopic horizontal rod, said one or more abrasive surfaces each made of a double sided tape, a strip of sand paper, or embedded sand granules; wherein said one or more abrasive surfaces are located on the top surface of the first or second telescopic horizontal rod to prevent items placed thereon from slipping off the first or second telescopic horizontal rod; and, (f) a shelf being positioned on the top surfaces of both of the first and second horizontal rods, the shelf being composed of an acrylic or clear plastic, the shelf having an upper securing edge that wraps around the first telescopic horizontal rod, a flat surface that extends downwardly across the top surface of the second telescopic horizontal rod, and a lower lip that prevents items placed on the shelf from slipping off a bottom edge of the shelf.

2. The closet storage system of claim 1, wherein the shelf can be removed from the first and second telescopic horizontal rods; and the first bracket arm extension, the second bracket arm extension, the third bracket arm extension, and the fourth bracket arm extension can be set so that the first and second telescopic horizontal rods are positioned longitudinally in parallel with each other when the shelf is removed from the first and second telescopic horizontal rods.

3. The closet storage system of claim 1 wherein the first bracket arm extension, the second bracket arm extension, the third bracket arm extension, and the fourth bracket arm extension can be set so that the first and second telescopic horizontal rods are positioned longitudinally in parallel with the first and second bracket plates.

4. The closet storage system of claim 1 wherein lengths of the first and second telescopic horizontal rods can be independently adjusted to accommodate a space in the closet storage area.

5. The closet storage system of claim 1 wherein the first bracket arm extension, the second bracket arm extension, the third bracket arm extension, and the fourth bracket arm extension can be set so that the first and second telescopic horizontal rods are positioned longitudinally in parallel with the vertical wall of the closet storage area.

6. The closet storage system of claim 1 wherein each of the extension arms can be set to provide different positioning, spacing, and placement of the first and second telescopic horizontal rods respectively in the closet storage area to support the placement of different sized items on the first and second telescopic horizontal rods.

7. A closet storage system comprising:

(a) a first telescopic horizontal rod that can be contracted or expanded lengthwise along its longitudinal axis, said first telescopic horizontal rod having:

a first rod element having a cylindrical shape with a first circumference, an interior end, and an exterior end, a second rod element having an interior end, an exterior end, and a cylindrical shape with a second circumference that is smaller than the first circumference of the first rod element such that the interior end of the second rod element fits within the circumference of the interior end of the first rod element, wherein said first telescopic horizontal rod can be contracted or expanded lengthwise along its longitudinal axis using the first rod element and the second rod element to accommodate a variable width in a closet storage area;

a fifth rod element having an interior end, an exterior end, and a cylindrical shape with a fifth circumference that is smaller than the first circumference of the first rod element such that the interior end of the fifth rod element fits within the circumference of the exterior end of the first rod element, said first telescopic horizontal rod being extendable longitudinally from the exterior end of the first rod element using the fifth rod element to accommodate a variable width in the closet storage area, a first end cap placed on said exterior end of the fifth rod element that prevents the entire fifth rod element from being completely inserted within the circumference of the first rod element and provides a raised end that prevents articles hung on the fifth rod element from unintentionally slipping off the exterior end of the fifth rod element;

a sixth rod element having an interior end, an exterior end, a cylindrical shape with a sixth circumference that is smaller than the second circumference of the second rod element such that the interior end of the sixth rod element fits within the circumference of the exterior end of the second rod element, said first telescopic horizontal rod being extendable longitudinally from the exterior end of the second rod element by sliding said sixth rod element to accommodate a variable width in the closet storage area; and, a second end cap placed on said exterior end of the sixth rod element that prevents the entire sixth rod element from being completely inserted within the circumference of the second rod element and provides a raised end that prevents articles hung on the sixth rod element from unintentionally slipping off the exterior end of the sixth rod element;

(b) a second telescopic horizontal rod that can be contracted or expanded lengthwise along its longitudinal axis, said second telescopic horizontal rod having:

a third rod element having a cylindrical shape with a third circumference, an interior end, and an exterior end, a fourth rod element having an interior end, an exterior end, and a cylindrical shape with a fourth circumference that is smaller than the third circumference of the third rod element such that the interior end of the fourth rod element fits within the circumference of an interior end of the third rod element, wherein said second telescopic horizontal rod can be contracted or expanded lengthwise along its longitudinal axis using the third rod element and the fourth rod element to accommodate a variable width in the closet storage area;

a seventh rod element having an interior end, an exterior end, and a cylindrical shape with a seventh circumference that is smaller than the third circumference of the third rod element such that the interior end of the seventh rod element fits within the circumference of the exterior end of the third rod element, said second telescopic horizontal rod being extendable longitudinally from the exterior end of the third rod element by sliding the seventh rod element to accommodate a variable width in the closet storage area, a third end cap placed on said exterior end of the seventh rod element that prevents the entire seventh rod element from being completely inserted within the circumference of the third rod element and provides a raised end that prevents articles hung on the seventh rod element from unintentionally slipping off the exterior end of the seventh rod element;

an eighth rod element having an interior end, an exterior end, and a cylindrical shape with an eighth circumference that is smaller than the fourth circumference of the fourth rod element such that the interior end of the eighth rod element fits within the circumference of the exterior end of the fourth rod element, said second telescopic horizontal rod being extendable longitudinally from the exterior end of the fourth rod element by sliding said eighth rod element to accommodate a variable width in the closet storage area; and, a fourth end cap placed on said exterior end of the eighth rod element that prevents the entire eighth rod element from being completely inserted within the circumference of the fourth rod element and provides a raised end that prevents articles hung on the eighth rod element from unintentionally slipping off the exterior end of the eighth rod element;

(c) a first bracket having a first bracket plate, a first bracket arm extension, and a second bracket arm extension, wherein the first bracket supports the first and second telescopic horizontal rods and fastens said first and second telescopic horizontal rods to a vertical wall of the closet storage area; the first and second bracket arm extensions of said first bracket adjustably setting: (i) the distances for the first and second telescopic horizontal rods from the first bracket plate, (ii) the angle of inclination between the first telescopic horizontal rod and the second telescopic horizontal rod relative to the first bracket plate, and (iii) the distances between the first telescopic horizontal rod and the second telescopic horizontal rod;

said first bracket arm extension being adjustably extendable outwardly from the first bracket plate of the first bracket, said first bracket arm extension having a first hook that wraps around the first telescopic horizontal rod to secure a position of said first telescopic horizontal rod on the first bracket, said first hook being open-ended to allow the first telescopic horizontal rod to be placed and removably repositioned on the first bracket;

said second bracket arm extension being adjustably extendable outwardly from the first bracket plate of the first bracket, said second bracket arm extension having a second hook that wraps around the second telescopic horizontal rod to secure a position of said second telescopic horizontal rod on the first bracket, said second hook being open-ended to allow the second telescopic horizontal rod to be placed and removably repositioned on the first bracket;

wherein the first bracket arm extension is above the second bracket arm extension so that the first telescopic horizontal rod is above the second telescopic horizontal rod; and the second bracket arm extension is longer than the first bracket arm extension so that the second telescopic horizontal rod can extend outwardly from the first bracket further than the first telescopic horizontal rod; and, (d) a second bracket having a second bracket plate, a third bracket arm extension, and a fourth bracket arm extension, wherein the second bracket supports the first and second telescopic horizontal rods and fastens said first and second telescopic horizontal rods to the vertical wall of the closet storage area; the third and fourth bracket arm extensions of said second bracket adjustably setting: (i) the distances for the first and second telescopic horizontal rods from the second bracket plate, (ii) the angle of inclination between the first telescopic horizontal rod and the second telescopic horizontal rod relative to the second bracket plate, and (iii) the distances between the first telescopic horizontal rod and the second telescopic horizontal rod;

said third bracket arm extension being adjustably extendable outwardly from the second bracket plate on the second bracket, said third bracket arm extension having a third hook that wraps around the first telescopic horizontal rod to secure the position of said first telescopic horizontal rod on the second bracket, said third hook being open-ended to allow the first telescopic horizontal rod to be placed and removably repositioned on the second bracket; and, said fourth bracket arm extension being adjustably extendable outwardly from the second bracket plate on the second bracket, said fourth bracket arm extension having a fourth hook that wraps around the second telescopic horizontal rod to secure the position of said second telescopic horizontal rod on the second bracket, said fourth hook being open-ended to allow the second telescopic horizontal rod to be placed and removably repositioned on the second bracket;

wherein the third bracket arm extension is above the fourth bracket arm extension so that the first telescopic horizontal rod is above the second telescopic horizontal rod; and the fourth bracket arm extension is longer than the third bracket arm extension so that the second telescopic horizontal rod can extend outwardly from the second bracket further than the first telescopic horizontal rod.

8. The closet storage system of claim 7 wherein lengths of the first and second telescopic horizontal rods can be independently adjusted to accommodate a space in the closet storage area.

9. The closet storage system of claim 7 wherein each of the extension arms can be set to provide different positioning, spacing, and placement of the first and second telescopic horizontal rods respectively in the closet storage area to support the placement of different sized items on the first and second telescopic horizontal rods.

10. The closet storage system of claim 7 wherein the first and second telescopic horizontal rods can be positioned to store items in an inclined manner with the first telescopic horizontal rod positioned above said second telescopic horizontal rod so that said items can be viewed in a downwardly sloping manner when placed on the first and second telescopic horizontal rods.

11. The closet storage system of claim 7 further comprising:

one or more abrasive surfaces on a top surface of the first or second telescopic horizontal rod, said one or more abrasive surfaces each made of a double sided tape, a strip of sand paper, or embedded sand granules.

12. The closet storage system of claim 11 wherein the one or more abrasive surfaces prevent items from slipping off the top surface of the first or second telescopic horizontal rod.

13. The closet storage system of claim 7 further comprising:

a shelf being positioned on a top surface of each of the first and second telescopic horizontal rods, said shelf being composed of an acrylic or clear plastic.

14. The closet storage system of claim 13 wherein the shelf has an upper securing edge that wraps around the first telescopic horizontal rod, a flat surface that extends downwardly across the top surface of the second telescopic horizontal rod, and an upwardly extending ledge with a lower lip that prevent items placed on the shelf from slipping off a bottom edge of the shelf.

15. A closet storage system comprising:

(a) a first telescopic horizontal rod that can be contracted or expanded lengthwise along its longitudinal axis, said first telescopic horizontal rod having:

a first rod element having a cylindrical shape with a first circumference, an interior end, and an exterior end, a second rod element having an interior end, an exterior end, and a cylindrical shape with a second circumference that is smaller than the first circumference of the first rod element such that the interior end of the second rod element fits within the circumference of the interior end of the first rod element, wherein said first telescopic horizontal rod can be contracted or expanded lengthwise along its longitudinal axis using the first rod element and the second rod element to accommodate a variable width in a closet storage area;

a fifth rod element having an interior end, an exterior end, and a cylindrical shape with a fifth circumference that is smaller than the first circumference of the first rod element such that the interior end of the fifth rod element fits within the circumference of the exterior end of the first rod element, said first telescopic horizontal rod being extendable longitudinally from the exterior end of the first rod element using the fifth rod element to accommodate a variable width in the closet storage area, a first end cap placed on said exterior end of the fifth rod element that prevents the entire fifth rod element from being completely inserted the circumference of the first rod element and provides a raised end that prevents articles hung on the fifth rod element from unintentionally slipping off the exterior end of the fifth rod element;

a sixth rod element having an interior end, an exterior end, a cylindrical shape with a sixth circumference that is smaller than the second circumference of the second rod element such that the interior end of the sixth rod element fits within the circumference of the exterior end of the second rod element, said first telescopic horizontal rod being extendable longitudinally from the exterior end of the second rod element by sliding said sixth rod element to accommodate a variable width in the closet storage area; and, a second end cap placed on said exterior end of the sixth rod element that prevents the entire sixth rod element from being completely inserted within the circumference of the second rod element and provides a raised end that prevents articles hung on the sixth rod element from unintentionally slipping off the exterior end of the sixth rod element;

(b) a second telescopic horizontal rod that can be contracted or expanded lengthwise along its longitudinal axis, said second telescopic horizontal rod having:

a third rod element having a cylindrical shape with a third circumference, an interior end, and an exterior end, a fourth rod element having an interior end, an exterior end, and a cylindrical shape with a fourth circumference that is smaller than the third circumference of the third rod element such that the interior end of the fourth rod element fits within the circumference of an interior end of the third rod element, wherein said second telescopic horizontal rod can be contracted or expanded lengthwise along its longitudinal axis using the third rod element and the fourth rod element to accommodate a variable width in the closet storage area;

a seventh rod element having an interior end, an exterior end, and a cylindrical shape with a seventh circumference that is smaller than the third circumference of the third rod element such that the interior end of the seventh rod element fits within the circumference of the exterior end of the third rod element, said second telescopic horizontal rod being extendable longitudinally from the exterior end of the third rod element by sliding the seventh rod element to accommodate a variable width in the closet storage area, a third end cap placed on said exterior end of the seventh rod element that prevents the entire seventh rod element from being completely inserted within the circumference of the third rod element and provides a raised end that prevents articles hung on the seventh rod element from unintentionally slipping off the exterior end of the seventh rod element;

an eighth rod element having an interior end, an exterior end, and a cylindrical shape with an eighth circumference that is smaller than the fourth circumference of the fourth rod element such that the interior end of the eighth rod element fits within the circumference of the exterior end of the fourth rod element, said second telescopic horizontal rod being extendable longitudinally from the exterior end of the fourth rod element by sliding said eighth rod element to accommodate a variable width in the closet storage area; and, a fourth end cap placed on said exterior end of the eighth rod element that prevents the entire eighth rod element from being completely inserted within the circumference of the fourth rod element and provides a raised end that prevents articles hung on the eighth rod element from unintentionally slipping off the exterior end of the eighth rod element;

(c) a first bracket having a first bracket plate, a first bracket arm extension, and a second bracket arm extension, wherein the first bracket supports the first and second telescopic horizontal rods and fastens said first and second telescopic horizontal rods to a vertical wall of the closet storage area; the first and second bracket arm extensions of said first bracket adjustably setting: (i) the distances for the first and second telescopic horizontal rods from the first bracket plate, (ii) the angle of inclination between the first telescopic horizontal rod and the second telescopic horizontal rod relative to the first bracket plate, and (iii) the distances between the first telescopic horizontal rod and the second telescopic horizontal rod;

said first bracket arm extension being adjustably extendable outwardly from the first bracket plate of the first bracket, said first bracket arm extension having a first securing element that wraps around the first telescopic horizontal rod to secure a position of said first telescopic horizontal rod on the first bracket, said second bracket arm extension being adjustably extendable outwardly from the first securing element, said second bracket arm extension having a second hook that wraps around the second telescopic horizontal rod to secure a position of said second telescopic horizontal rod on the first bracket, said second hook being open-ended to allow the second telescopic horizontal rod to be placed and removably repositioned on the first bracket; and, (d) a second bracket having a second bracket plate, a third bracket arm extension, and a fourth bracket arm extension, wherein the second bracket supports the first and second telescopic horizontal rods and fastens said first and second telescopic horizontal rods to the vertical wall of the closet storage area, the third and fourth bracket arm extensions of said second bracket adjustably setting: (i) the distances for the first and second telescopic horizontal rods from the second bracket plate, (ii) the angle of inclination between the first telescopic horizontal rod and the second telescopic horizontal rod relative to the second bracket plate, and (iii) the distances between the first telescopic horizontal rod and the second telescopic horizontal rod;

said third bracket arm extension being adjustably extendable outwardly from the second bracket plate of the second bracket, said third bracket arm extension having a second securing element that wraps around the first telescopic horizontal rod to secure the position of said first telescopic horizontal rod on the second bracket, said fourth bracket arm extension being adjustably extendable outwardly from the second securing element, said fourth bracket arm extension having a fourth hook that wraps around the second telescopic horizontal rod to secure the position of said second telescopic horizontal rod on the second bracket, said fourth hook being open-ended to allow the second telescopic horizontal rod to be placed and removably repositioned on the second bracket.

16. The closet storage system of claim 15 wherein lengths of the first and second telescopic horizontal rods can be independently adjusted to accommodate a space in the closet storage area.

17. The closet storage system of claim 15 wherein each of the extension arms can be set to provide different positioning, spacing, and placement of the first and second telescopic horizontal rods respectively in the closet storage area to support the placement of different sized items on the first and second telescopic horizontal rods.

18. The closet storage system of claim 15 wherein the first and second telescopic horizontal rods can be positioned to store items in an inclined manner with the first telescopic horizontal rod positioned above said second telescopic horizontal rod so that said items can be viewed in a downwardly sloping manner when placed on the first and second telescopic horizontal rods.

19. The closet storage system of claim 15 further comprising:

one or more abrasive surfaces on a top surface of the first or second telescopic horizontal rod, said one or more abrasive surfaces each made of a double sided tape, a strip of sand paper, or embedded sand granules.

20. The closet storage system of claim 19 wherein the one or more abrasive surfaces prevent items from slipping off the top surface of the first or second telescopic horizontal rod.

21. The closet storage system of claim 15 further comprising:

a shelf being positioned on a top surface of each of the first and second telescopic horizontal rods, said shelf being composed of an acrylic or clear plastic.

22. The closet storage system of claim 21 wherein the shelf has an upper securing edge that wraps around the first telescopic horizontal rod, a flat surface that extends downwardly across the top surface of the second telescopic horizontal rod, and an upwardly extending ledge with a lower lip that prevent items placed on the shelf from slipping off a bottom edge of the shelf.

* * * * *